US007911393B2

(12) United States Patent
Zhang

(10) Patent No.: US 7,911,393 B2
(45) Date of Patent: Mar. 22, 2011

(54) ANTENNA DEVICE

(75) Inventor: Xin Zhang, Hitachi (JP)

(73) Assignee: Hitachi Cable, Ltd., Chiyoda-ku, Tokyo (JP)

( * ) Notice: Subject to any disclaimer, the term of this patent is extended or adjusted under 35 U.S.C. 154(b) by 0 days.

(21) Appl. No.: 12/588,224

(22) Filed: Oct. 8, 2009

(65) Prior Publication Data

US 2010/0103067 A1 Apr. 29, 2010

Related U.S. Application Data

(62) Division of application No. 12/010,156, filed on Jan. 22, 2008, now Pat. No. 7,642,965, which is a division of application No. 11/131,186, filed on May 18, 2005, now Pat. No. 7,443,345.

(51) Int. Cl.
*H01Q 1/38* (2006.01)
*H01Q 3/12* (2006.01)

(52) U.S. Cl. ..... 343/700 MS; 343/761; 343/754

(58) Field of Classification Search ..... None
See application file for complete search history.

(56) References Cited

U.S. PATENT DOCUMENTS

| | | | | |
|---|---|---|---|---|
| 5,274,391 | A | 12/1993 | Connolly | |
| 5,552,798 | A | 9/1996 | Dietrich et al. | |
| 6,008,773 | A | 12/1999 | Matsuoka et al. | |
| 6,106,256 | A | 8/2000 | Talaski | |
| 6,259,415 | B1 * | 7/2001 | Kumpfbeck et al. | 343/765 |
| 6,542,125 | B1 | 4/2003 | Hoffmeister et al. | |
| 6,759,988 | B2 | 7/2004 | Purr et al. | |
| 6,885,352 | B2 | 4/2005 | Lee et al. | |
| 6,917,332 | B2 | 7/2005 | Aikawa et al. | |
| 6,992,635 | B2 | 1/2006 | Nishiyama et al. | |
| 7,109,937 | B2 * | 9/2006 | Iluz et al. | 343/757 |
| 7,187,334 | B2 * | 3/2007 | Franson et al. | 343/713 |
| 7,385,562 | B2 * | 6/2008 | Stoyanov et al. | 343/765 |
| 7,486,235 | B2 | 2/2009 | Leeper et al. | |
| 7,570,222 | B2 * | 8/2009 | King | 343/765 |

FOREIGN PATENT DOCUMENTS

| | | |
|---|---|---|
| JP | 62-091005 | 4/1987 |
| JP | 63-106208 | 7/1988 |
| JP | 2-33202 | 2/1990 |
| JP | 02-057003 | 2/1990 |
| JP | 7-142927 | 6/1995 |
| JP | 7-183717 | 7/1995 |
| JP | 8-125435 | 5/1996 |
| JP | 8-181538 | 7/1996 |

(Continued)

OTHER PUBLICATIONS

Japanese Office Action dated May 15, 2007, with English translation.

(Continued)

*Primary Examiner* — Trinh V Dinh
(74) *Attorney, Agent, or Firm* — McGinn IP Law Group, PLLC

(57) ABSTRACT

An antenna device includes a dielectric substrate, an electric supply line that includes a microstrip line and is formed on the dielectric substrate, an antenna element that includes a microstrip line and is formed on the dielectric substrate, and a reflector plate disposed on the dielectric substrate at a predetermined angle of inclination. The reflector plate is allowed to move relative to the dielectric substrate while keeping the predetermined angle of inclination.

3 Claims, 34 Drawing Sheets

FOREIGN PATENT DOCUMENTS

| | | |
|---|---|---|
| JP | 9-252216 | 9/1997 |
| JP | 11-31915 | 2/1999 |
| JP | 11-215040 | 8/1999 |
| JP | 2000-244241 | 9/2000 |
| JP | 2002-508900 | 3/2002 |
| JP | 2002-325016 | 11/2002 |
| JP | 2005-39415 | 2/2005 |
| JP | 2005-45450 | 2/2005 |
| JP | 2005-229284 | 8/2005 |
| WO | WO 98/56065 | 12/1998 |

OTHER PUBLICATIONS

Japanese Office Action dated Sep. 18, 2007, with English translation.

Notification of Reason(s) for Refusal dated Jan. 22, 2008, with English translation.

Japanese Office Action dated May 20, 2008, with English Translation.

* cited by examiner

ANTENNA DEVICE

CROSS-REFERENCE TO RELATED APPLICATIONS

The present application is a divisional application of U.S. patent application Ser. No. 12/010,156, filed on Jan. 22, 2008, now U.S. Pat. No. 7,642,965 which is a divisional application of U.S. patent application Ser. No. 11/131,186, filed on May 18, 2005, now U.S. Pat. No. 7,443,345.

The present application is based on Japanese patent application Nos. 2003-198478, 2003-201823, and 2004-035117, the entire contents of which are incorporated herein by reference.

BACKGROUND OF THE INVENTION

1. Field of the Invention

This invention relates to an antenna device used in a base station antenna or the like for mobile communications, and more particularly to an antenna device in which a desired directivity angle is realized by a simple construction.

2. Description of the Related Art

In a base station antenna for mobile communications, a service area from which communication service can be provided is influenced remarkably by a directivity in the horizontal plane of the base station antenna. In case of establishing a base station antenna, it is desirable to locate it in the best place where all the service areas intended to cover can be fully provided without accompanying any unnecessary details. In other words, even if an electric power is delivered to an area where no mobile station exists, resulting in a loss of energy, while it becomes a problem, when no electric power is delivered to an area where some mobile stations exist.

In reality, there is a case where the best place is on a road or the other places where an antenna is hardly set up. Thus, there are frequently such a case where an antenna must be set up in a place where is that near to the best place, i.e. a next-best place. For instance, when it is intended to contain principally a service area along a longitudinal direction of a road 91 as shown in FIG. 1 by the use of an antenna having a directivity of an 8-figure shape in the horizontal plane, the best place is in the central point 92 of the road. However, the antenna cannot be located at the central point of the road, so that it is disposed on an electric pole, a telephone booth and the like positioned at a side of the road in reality.

In this case, however, when a base station antenna having an 8-figure shape directivity 94 is set up at a point 93 on a side of the road as shown in FIG. 1, an area contains inevitably a region which is not required principally for a service area, in other words, a building 96 faced to the road which is unnecessary for the service area is contained inevitably therein, so that there are useless regions. In FIG. 1, even if an antenna having omnidirectivity (a circular directivity) in the horizontal plane is used in place of an antenna having an 8-figure shape directivity, a demand for containing principally a region extending along the longitudinal direction of the road 91 cannot be attained.

A directivity in the horizontal plane of an ideal antenna suitable for a place shown in FIG. 1 in which an antenna is to be set up is that as indicated by a broken line 97. When the antenna has the directivity as indicated by the broken line 97, it can reduce a region in a service area covering the building 96.

In recent years, the number of mobile stations existing in a narrow area increases with progress of mobile station instruments. In this connection, when a base station antenna applying an omnidirectional antenna thereto is set up as shown in FIG. 2A to establish a circular service area surrounding a setting place 201, the sufficient number of channels cannot be ensured for the number of mobile stations, because of the limited number of channels which can be provided by a single base station. Under the circumstances, it is considered for ensuring the sufficient number of channels in each service area that a plurality of antennas each having a comparatively narrow directivity is set up at the same place, whereby different directions are covered to establish service areas, respectively. For instance, when three antennas each having 120° directivity angle are set up at the same setting place 201 as shown in FIG. 2B, service areas each having a sector form directing to a different direction, respectively, are shared, so that the number of channels being three times larger than that in the case where circular service areas are set up can be ensured.

However, when the number of mobile stations increases further, it is required that four or more of antennas are set up at the same setting place 201 so as to obtain narrower service areas as shown in FIG. 2C. In this case, since each service area 202 has each narrower angle, a directivity must be remarkably narrowed in each antenna.

Japanese patent application laid-open No. 11-31915 (prior art 1) discloses such a technology that omnidirectivity is obtained over a comparatively broad band by means of a substrate type antenna wherein electric supply lines composed of microstrip lines and antenna elements composed of microstrip lines are formed on a dielectric substrate.

On one hand, Japanese patent application laid-open No. 8-125435 (prior art 2) discloses such a technology that a reflector plate is opposed to an omnidirectional antenna, whereby such characteristics wherein a characteristic configuration of omnidirectivity is shifted unidirectionally are obtained, so that a circular service area is deviated away from a building.

However, even when a reflector plate is disposed so as to oppose to an omnidirectional antenna as in the prior art 2, only a directivity with a narrow directivity angle is obtained. Accordingly, such directivity in the horizontal plane of an antenna which can reduce a service area covering a side of the building as desired in FIG. 1, in other words, a wide directivity more than 120° directivity angle is not easily obtained. On the other hand, the directivity in the horizontal plane indicated by the broken line 97 cannot be obtained by an omnidirectional antenna as in the prior art 1.

Furthermore, when plural antennas are set up at the same place in order that a service area is divided into narrower regions, it is required that a directivity angle of each of the antennas has a desired narrow angle in response to the number of division.

As is apparent from the above description, such an antenna in which a desired directivity angle extending over a range of from a wide directivity angle of 180° to a narrow directivity angle of about 30° is obtained by a simple construction is demanded.

SUMMARY OF THE INVENTION

It is an object of the invention to provide an antenna device that a desired directivity angle can be obtained by a simple construction.

(1) According to one aspect of the invention, an antenna device, comprises:

a plurality of substrate type antennas arranged in a direction, each of the substrate type antennas comprising a dielectric substrate, an electric supply line that comprises a microstrip line and is formed on the dielectric substrate, and antenna elements each of which includes microstrip lines and formed on the dielectric substrate; and a reflector plate located along the direction that the substrate type antennas are arranged, wherein the substrate type antennas each have different angles of inclination relative to the reflector plate.

In the antenna device the substrate type antennas may have an elliptical directivity.

Further, the antenna device may further include:

a plurality of subsidiary reflector plates that are orthogonal to the reflector plate, wherein the dielectric substrate is sandwiched by the two subsidiary reflector plates.

(2) According to another aspect of the invention, an antenna device comprises:

a dielectric substrate;

an electric supply line that comprises a microstrip line and is formed on the dielectric substrate;

an antenna element that comprises a microstrip line and is formed on the dielectric substrate; and a reflector plate disposed on the dielectric substrate at a predetermined angle of inclination, wherein the reflector plate is allowed to move relative to the dielectric substrate while keeping the predetermined angle of inclination.

In the antenna device, the electric supply line and the antenna element may deviate from a dimensional factor that allows the electric supply line and the antenna element to have an omnidirectivity, and the electric supply line and the antenna element may have a dimensional factor that allows the electric supply line and the antenna element to have an elliptical directivity.

Further, in the antenna device the electric supply line and the antenna element may deviate from a dimensional factor that allows the electric supply line and the antenna element to have an omnidirectivity, and the electric supply line and the antenna element may have a dimensional factor that allows the electric supply line and the antenna element to have an elliptical directivity.

BRIEF DESCRIPTION OF THE DRAWINGS

The present invention will be explained in more detail in conjunction with appended drawings, wherein.

DESCRIPTION OF THE EXEMPLARY EMBODIMENTS

Exemplary embodiments of the present invention will be described in detail hereinafter.

First Embodiment

Figure 3:
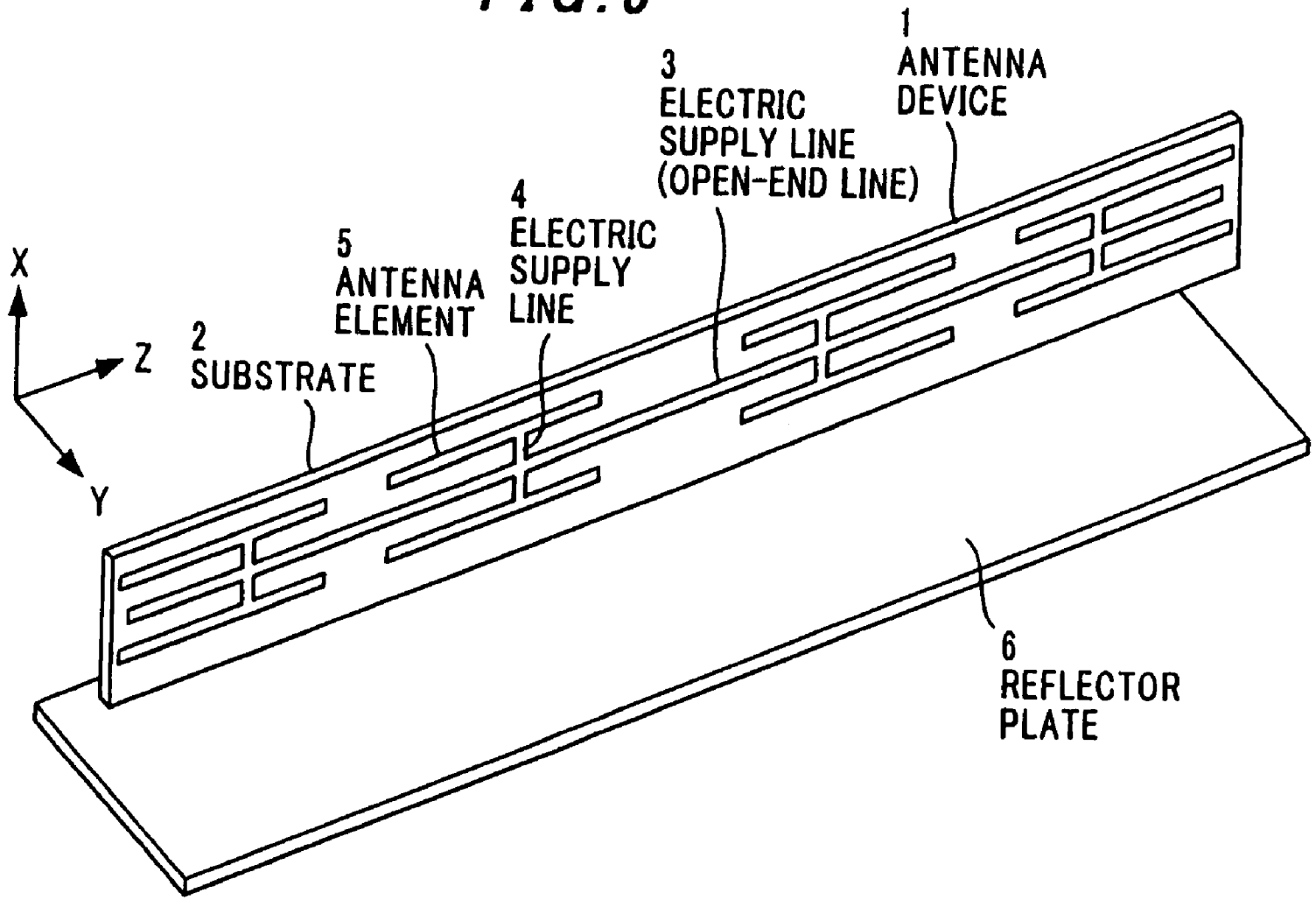
FIG. 3 is a perspective view showing an antenna device according to a first embodiment of the present invention.
Figure 4:
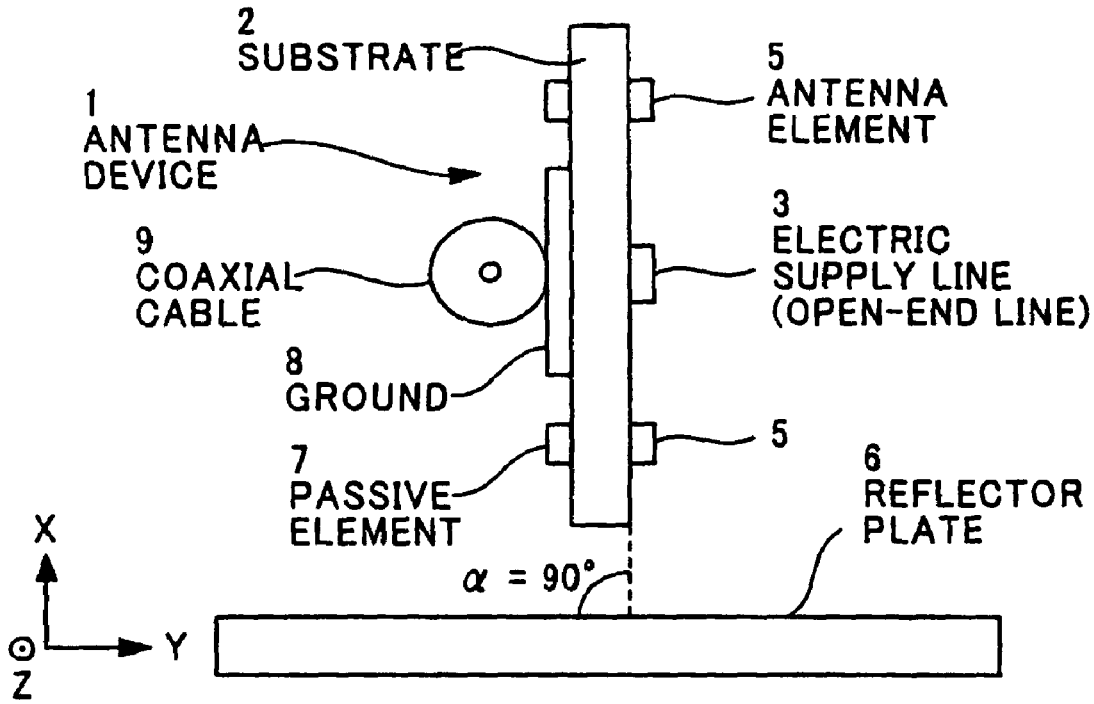
FIG. 4 is a side view showing the antenna device of FIG. 3 viewed from z-axis direction.

As shown in FIGS. 3 and 4, an antenna device 1 according to the present invention includes a substrate type antenna 10 which is fabricated by such a manner that an electric supply line (called also open-end line) 3 composed of microstrip lines extending along the longitudinal direction of a substrate 2, antenna elements 5 each composed of microstrip lines, and electric supply lines 4 each composed of microstrip lines and for connecting the electric supply line 3 with the antenna element 5 are formed on either surface of the substrate 2, while a passive element 7 composed of microstrip wires, and a ground 8 made of an electric conductor are formed the other surface of the substrate 2.

The ground 8 is positioned on the reverse side of the electric supply line 3, and the passive element 7 is positioned on the reverse side of the antenna elements 5. A coaxial cable 9 for supplying electric power from an external transmission and reception instrument (not shown) to the substrate is located along the ground 8.

It is to be noted that although the passive element 7 is disposed at a position corresponding to that of the antenna element 5 on the reverse side thereof on which the antenna element 5 is formed in the substrate type antenna according to the present embodiment, the passive element 7 may be located on the same side of the substrate 2 on which the antenna elements 5 are disposed so as to be parallel thereto. The antenna element 5 has half a wavelength in electrical length along the longitudinal direction.

In FIGS. 3 and 4, a direction indicated by z-axis is the vertical direction with respect to the horizontal plane. Namely, the substrate 2 is set up in such that the longitudinal direction of the substrate 2 is kept to be vertical with respect to the horizontal plane. Dimensional factors of the electric supply line 4 and the antenna element 5 for deciding a directivity of the antenna device 1 include a length of the electric supply line 4 (a distance between the open-end line 3 and the antenna element 5), a distance between two adjacent electric supply lines 4 positioned on the open-end line 3 along the longitudinal direction of the substrate 2, a distance between two adjacent antenna elements 5, 5 along the longitudinal direction of the substrate 2 and the like. When these dimensional factors are made to be either values obtained through multiplication of an applied frequency $\lambda$ by an integer, or ones being each simple common fraction of such frequency $\lambda$, omnidirectivity (a circular figure directivity) in the horizontal plane can be obtained. Details are as described in the prior art 1.

Figure 5:
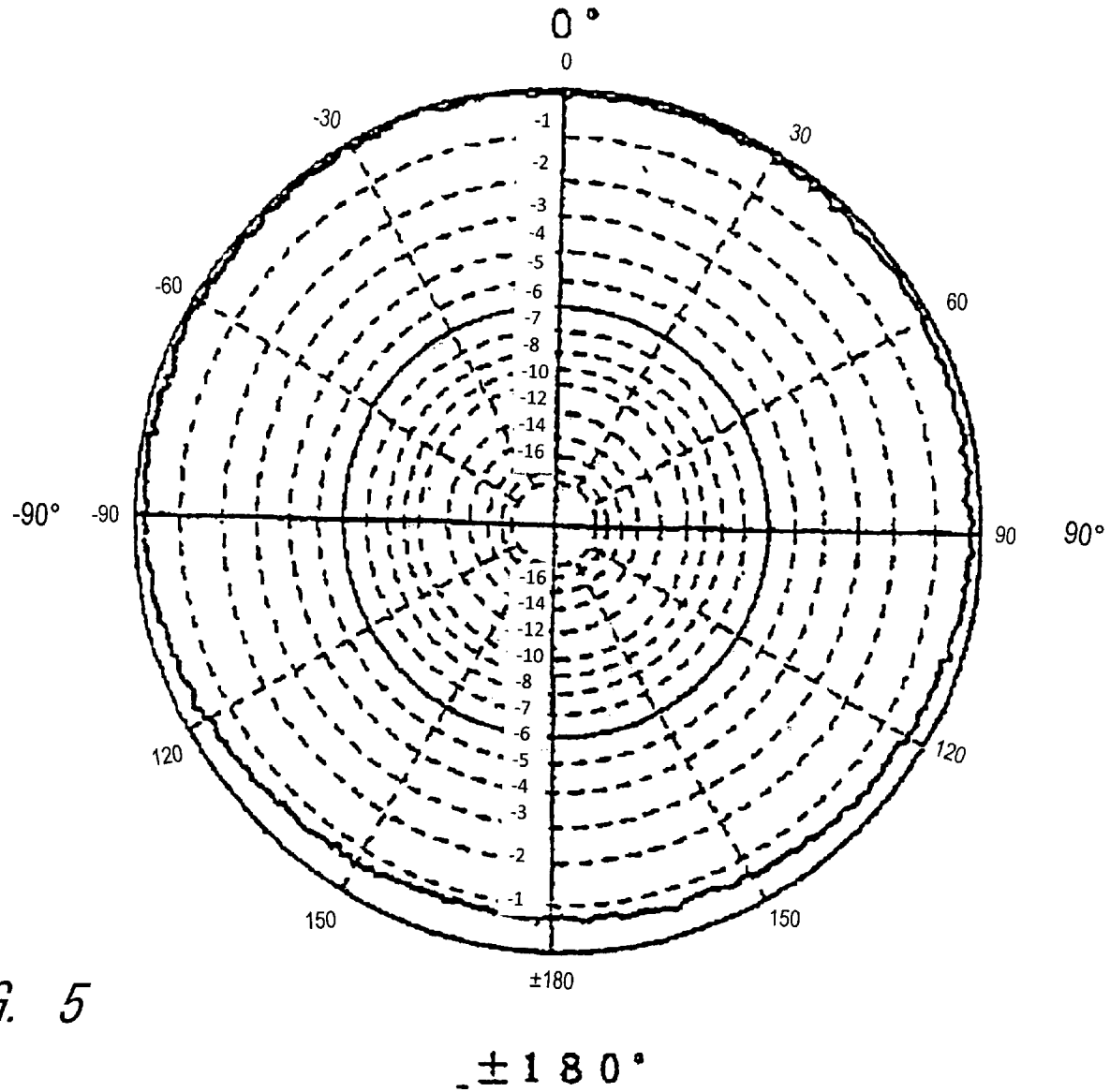
FIG. 5 is a characteristic diagram showing a directivity in the horizontal plane (omnidirectivity) of a conventional antenna device.

An example of such circular figure directivity is shown in FIG. 5 wherein although a gain at ±180° (the reverse direction to the x-axis in FIG. 3) is somewhat small with respect to a gain at 0° (the x-axis direction in FIG. 3), but it is in a degree of experimental error.

In the present invention, a dimensional factor due to which the above-described omnidirectivity is achieved is intentionally avoided, and, for example, a value which cannot be easily obtained from the applied frequency $\lambda$ is used, whereby a dimensional factor due to which an elliptical directivity in the horizontal plane is obtained is adopted. More specifically, a distance between two adjacent antenna elements 5, 5 along the longitudinal direction of the substrate 2 due to which omnidirectivity is obtained is changed to another distance.

Figure 6:
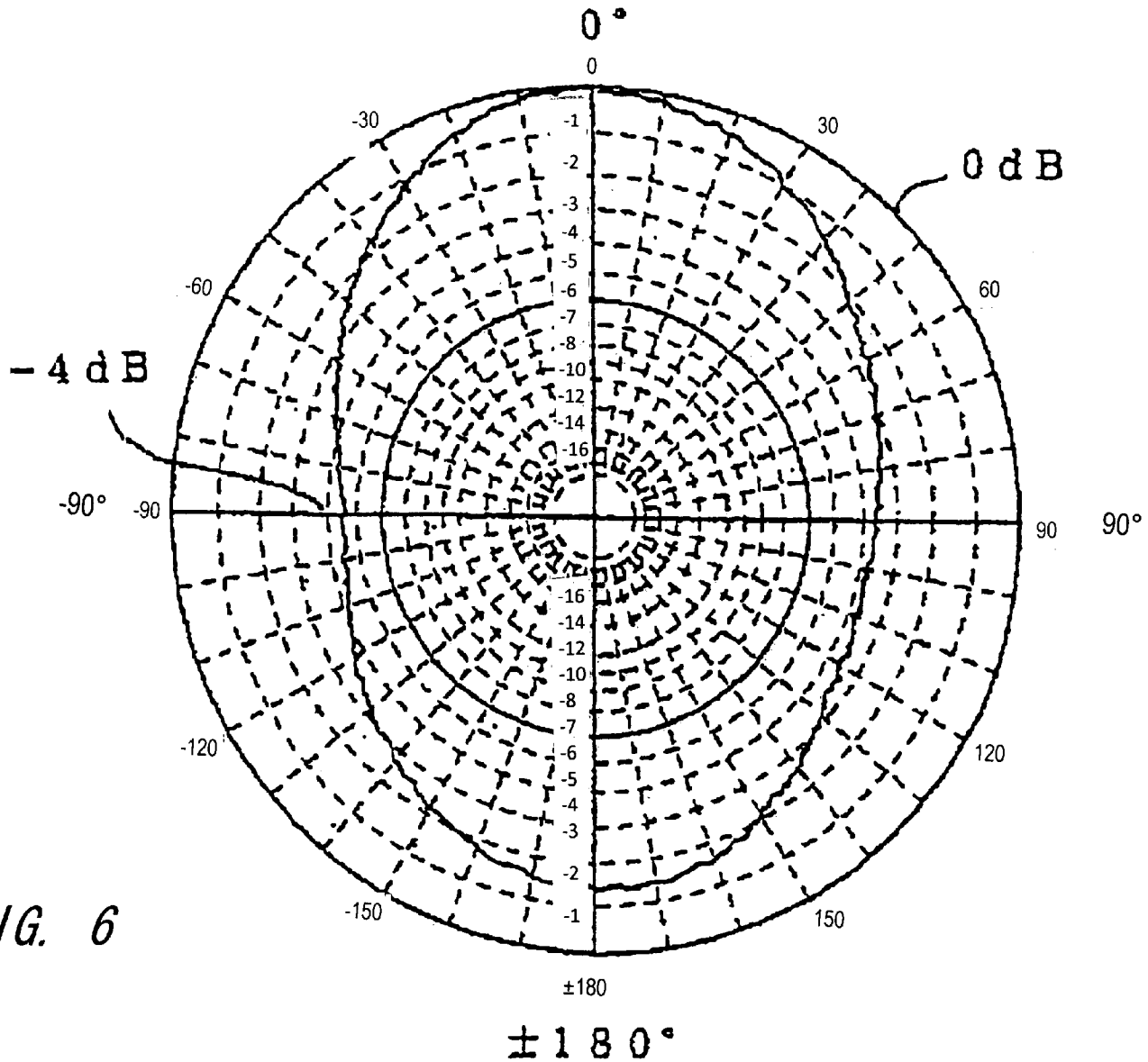
FIG. 6 is a characteristic diagram showing a directivity in the horizontal plane of an elementary substrate of the antenna device shown in FIG. 3.

An example of the elliptical directivity thus obtained is shown in FIG. 6 wherein a gain at ±90° (the y-axis direction in FIG. 3) is around 3 dB smaller than that of 0° and ±180° (the x-axis direction in FIG. 3) as shown in the figure.

Returning to FIGS. 3 and 4, a reflector plate 6 is disposed so as to have 90° angle of inclination in the horizontal plane with respect to the substrate 2 in the antenna device 1 according to the present invention. In other words, the substrate 2 extends along the x-axis, while the reflector plate 6 is disposed in parallel to the y-axis.

Figure 7:
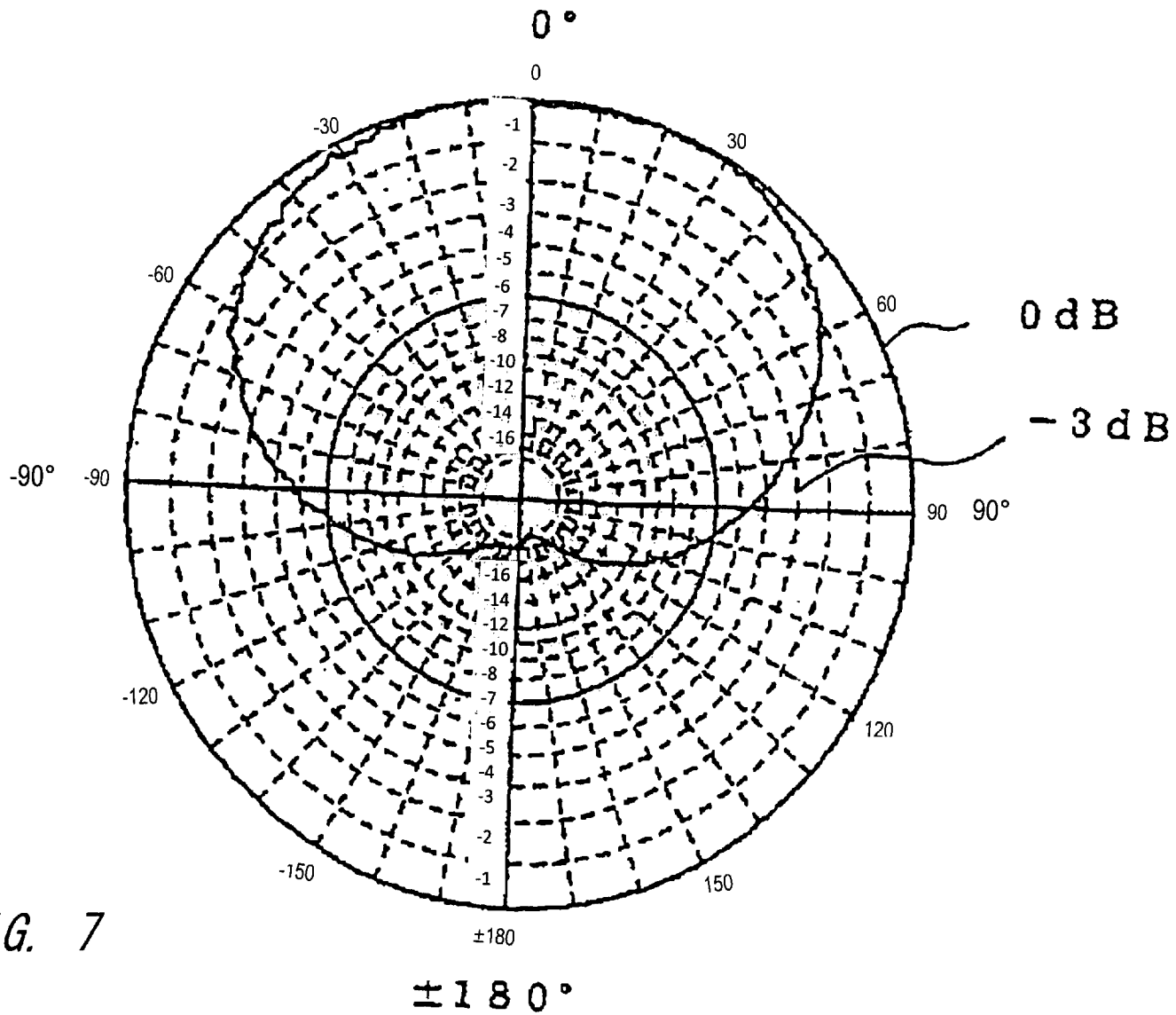
FIG. 7 is a characteristic diagram showing a directivity in the horizontal plane of the antenna device shown in FIG. 3.

FIG. 7 shows a directivity in the horizontal plane of the antenna device 1 shown in FIG. 3 wherein a directivity deviating remarkably to a semicircle on the side including 0° is obtained as shown in the figure. When viewed an angle at which −3 dB gain is obtained on the basis of the maximum gain, it is ±80°, i.e. 160° directivity angle is obtained.

Figure 1:
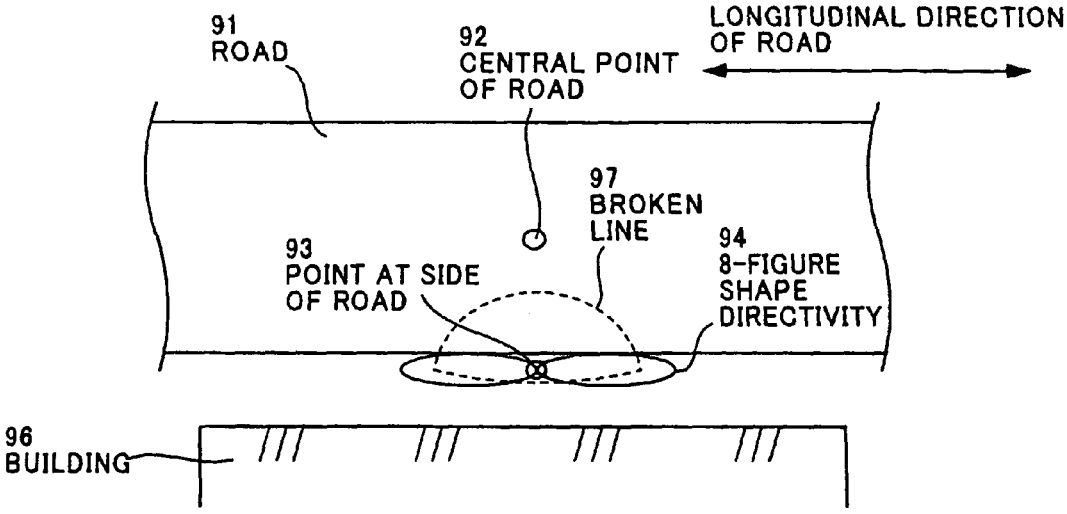
FIG. 1 PRIOR ART
FIG. 1 is a plan view showing a road and a periphery thereof wherein a base station antenna is set up on a side of the road.

When the antenna device 1 of FIG. 3 having characteristics as shown in FIG. 7 is applied to the environment as shown in FIG. 1 wherein an antenna device is to be set up, the resulting directivity in the horizontal plane becomes that indicated by the broken line 97, so that a service area which covers inevitably a side of the building 96 is reduced, whereby a region along the longitudinal direction of the road 91 can be contained principally in the service area. When the characteristics indicated by the broken line 97 are compared with those which are achieved by shifting unidirectionally an omnidirectional characteristic figure as described in the prior art 2, a less electric power than that of the prior art case is delivered to an area in which any mobile station cannot absolutely exist. In other words, it is an economical way.

The antenna device 1 shown in FIG. 3 is obtained by such a manner that a dimensional factor of a conventional omnidirectional substrate type antenna is deviated intentionally to acquire another dimensional factor due to which the elliptical directivity of FIG. 6 is achieved. Besides, the reflector plate 6 is disposed to the substrate 2 so as to have 90° angle of inclination in the horizontal plane. Accordingly, the characteristics shown in FIG. 7, which cannot be attained by such an arrangement that even if a reflector plate is added to an omnidirectional substrate type antenna as in the prior art 2, can be realized.

It is to be noted that the reflector plate 6 may be disposed with respect to the substrate 2 so as either to be in contact with the edge thereof, or to be suitably apart from the edge of the substrate 2. A distance from the antenna element 5 to the reflector plate 6 may be adjusted so as to obtain a good directivity in FIG. 7. A width in the y-axis direction may be also adjusted so as to obtain a good directivity in FIG. 7. A length of the reflector plate 6 in the z-axis direction is made to be substantially equal to that of the substrate 2 in the z-axis direction. In FIG. 3, although only four stages of the antenna elements 5 in the z-axis direction are shown, they may be more or less than four stages.

Second Embodiment

Figure 8:
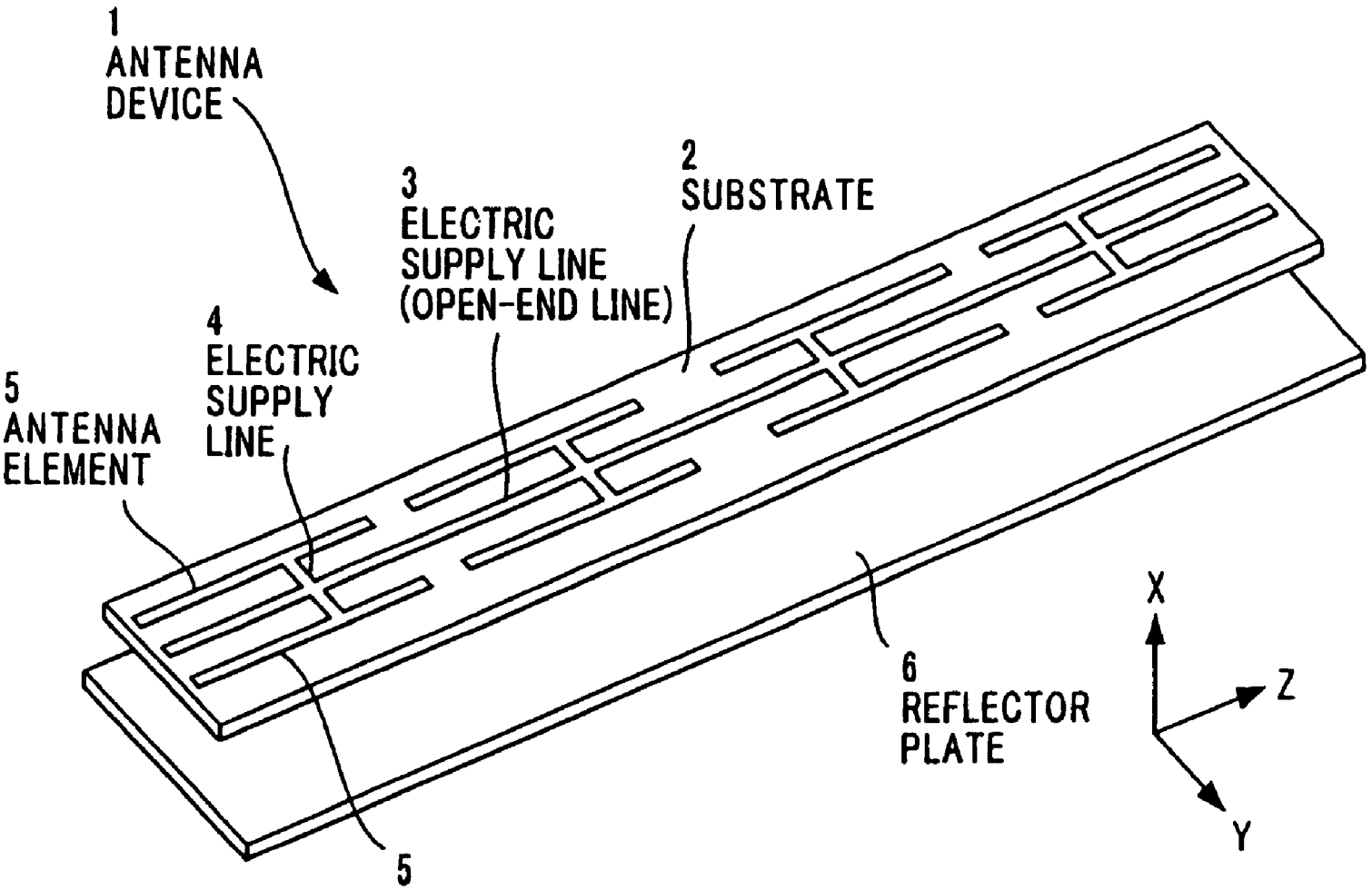
FIG. 8 is a perspective view showing an antenna device according to a second embodiment of the present invention.
Figure 9:
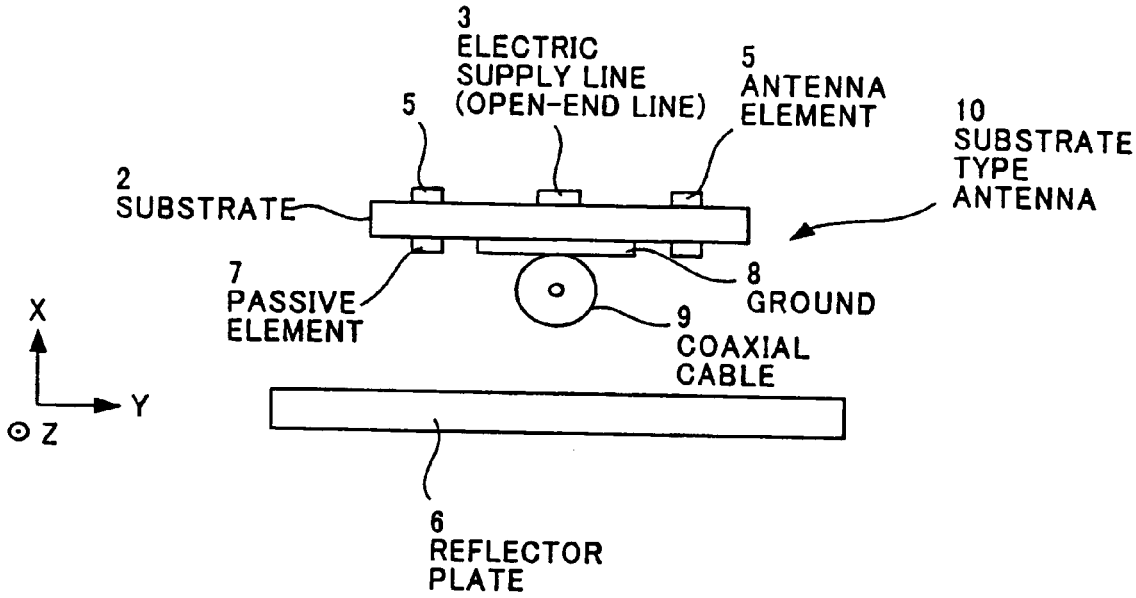
FIG. 9 is a side view showing the antenna device of FIG. 8 viewed from z-axis direction.

As shown in FIGS. 8 and 9, a reflector plate 6 is disposed with respect to a substrate 2 so as to have 0° angle of inclination in the horizontal plane in an antenna device 1. In other words, when the substrate 2 extends along y-axis, the reflector plate 6 is located in parallel to the y-axis. The substrate 2 is the same as that shown in FIG. 3. Namely, the substrate 2 has such a dimensional factor due to which an elliptical directivity wherein a gain at ±90° (x-axis direction in FIG. 8) is around 3 dB smaller than that at 0° and ±180° (y-axis direction in FIG. 8) in the horizontal plane is achieved. A distance from the antenna element 5 to the reflector plate 6 may be adjusted so as to have a good directivity in FIG. 10. On one hand, a width of the reflector plate 6 in the y-axis direction may be adjusted so as to have the good directivity in FIG. 10. In this case, a length of the reflector plate 6 in z-axis direction is made to be substantially the same as that of the substrate 2 in the z-axis direction.

Figure 10:
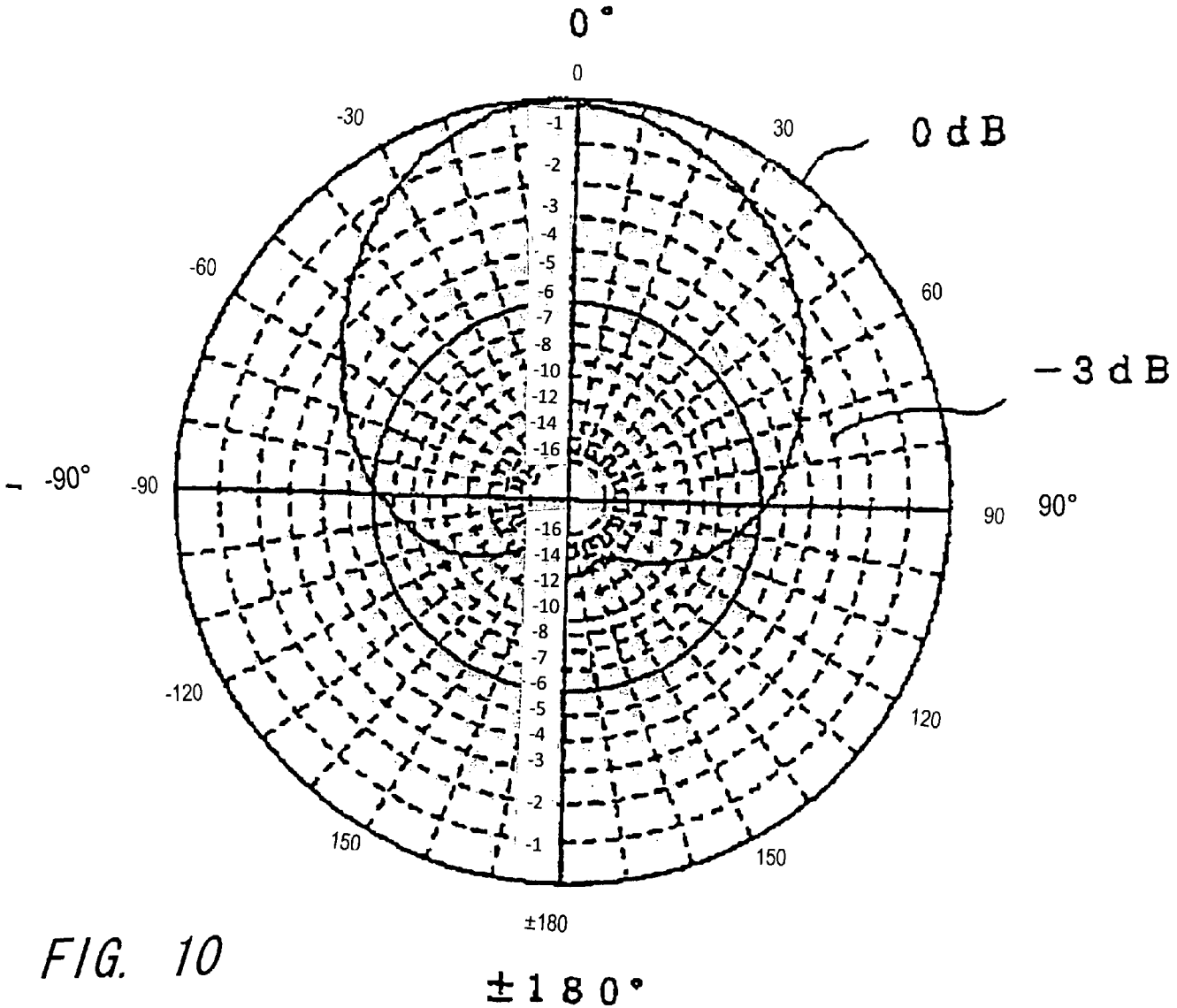
FIG. 10 is a characteristic diagram showing a directivity in the horizontal plane of the antenna device shown in FIG. 8.

FIG. 10 shows a directivity in the horizontal plane of the antenna device 1 of FIG. 8 wherein a directivity having 120° directivity angle is achieved as shown in the figure. When viewed an angle at which −3 dB is achieved on the basis of a gain at 0° at which the gain becomes the maximum, it is ±60°, namely, 120° directivity angle is obtained.

Figure 2A:
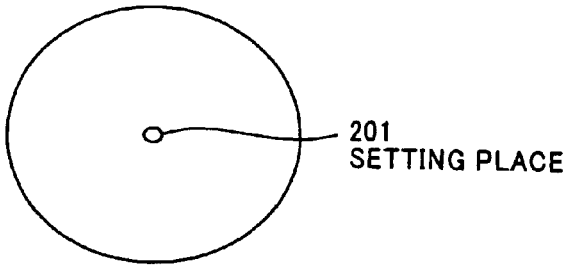
FIG.2A PRIOR ART
FIGS. 2A to 2C are plan views each showing an appearance wherein a plurality of service areas is established around a place at which one base station antenna is set up.
Figure 2B:
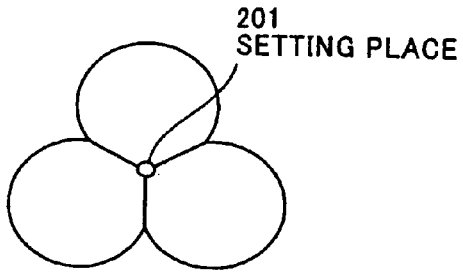
FIG.2B PRIOR ART
Figure 2C:
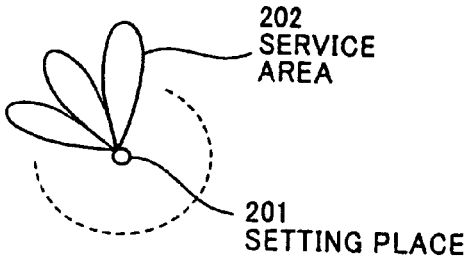
FIG.2C PRIOR ART

When a plurality of the antenna devices 1 of FIG. 8 each having characteristics of a small directivity angle of a directivity in the horizontal plane as shown in FIG. 10 is set up in the same place at each different direction, respectively, a service area can be divided into small regions as shown in FIG. 2B or FIG. 2C.

Figure 11:
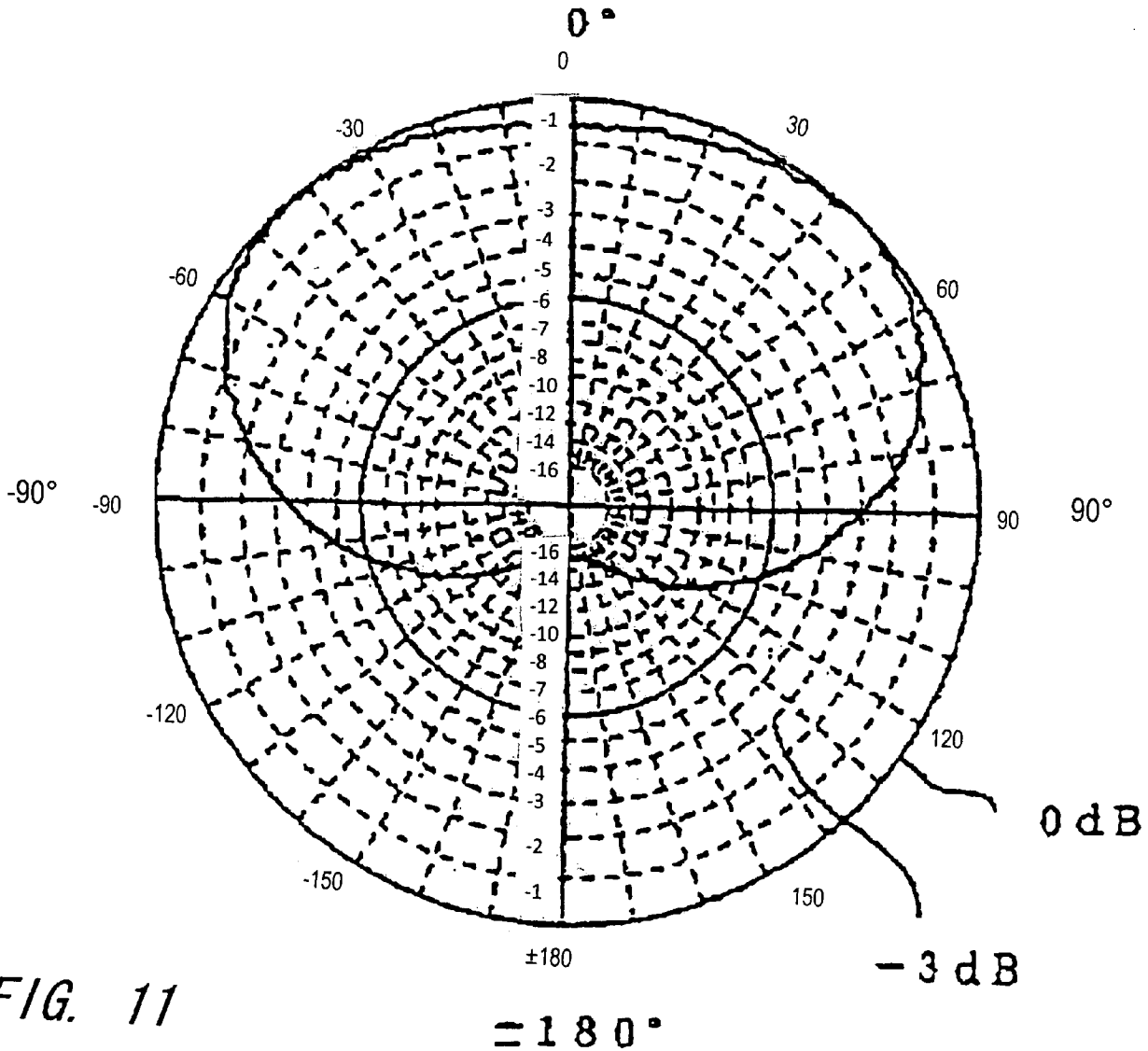
FIG. 11 is a characteristic diagram showing a directivity in the horizontal plane of a modification of the antenna device shown in FIG. 3.

FIG. 11 shows a directivity in the horizontal plane of the antenna device 1 of FIG. 3 as in the case of FIG. 7. FIG. 11 differs from FIG. 7 in elliptical directivity under a situation of which there is no reflector plate 6. More specifically, a distance between two adjacent antenna elements 5, 5 in the longitudinal direction of the substrate 2 is allowed to differ from that based on which the characteristics shown in FIG. 6 are obtained. As shown in FIG. 11, a directivity which deviates remarkably to a side including 0° of a semicircular figure is achieved. When an angle at which −3 dB is obtained is observed on the basis of the maximum gain, it is ±90°, namely, 180° directivity angle is achieved.

Third Embodiment

Figure 12:
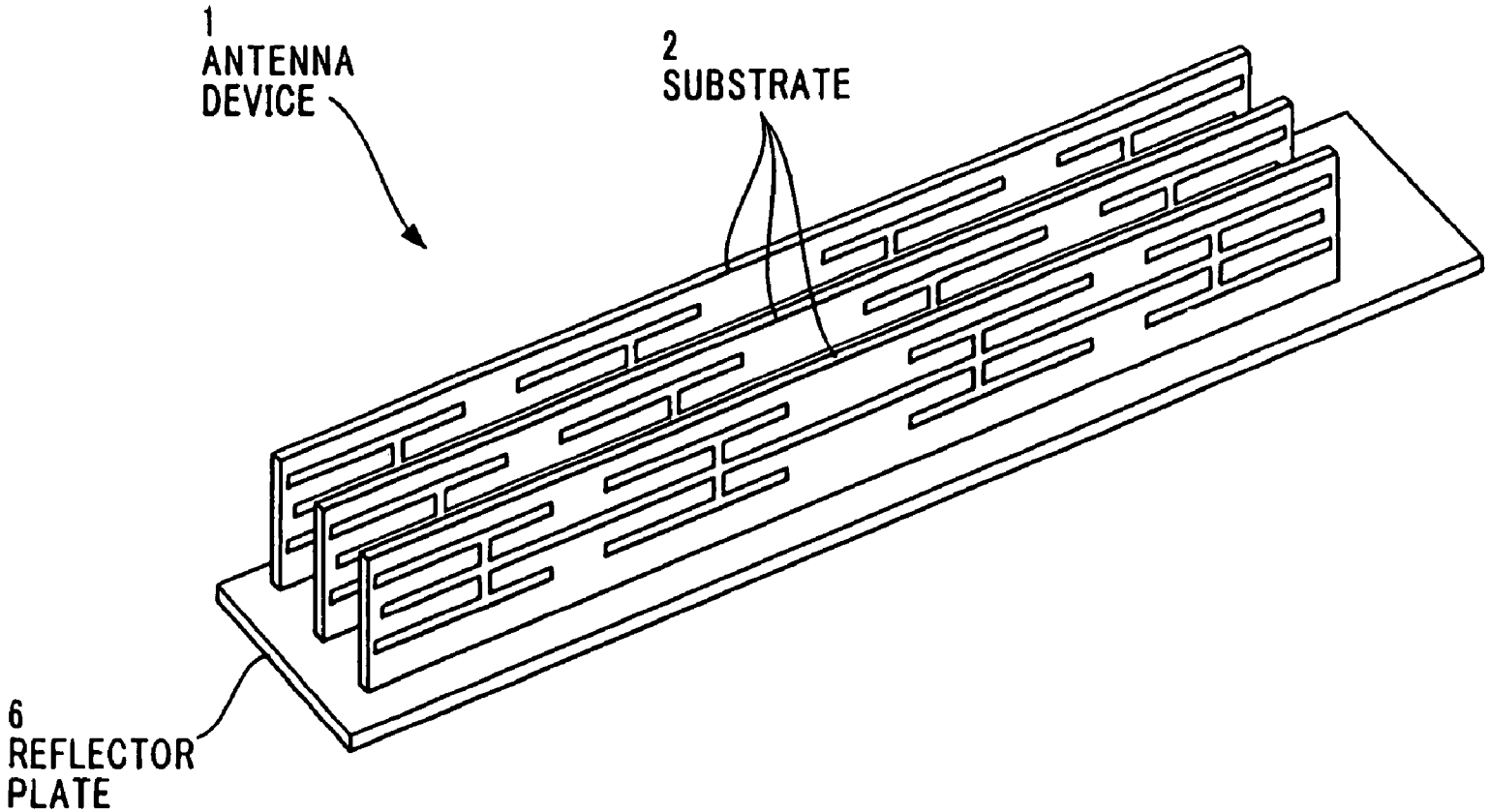
FIGS. 12 and 13 are perspective views each showing an antenna device according to a third embodiment of the present invention.
Figure 13:
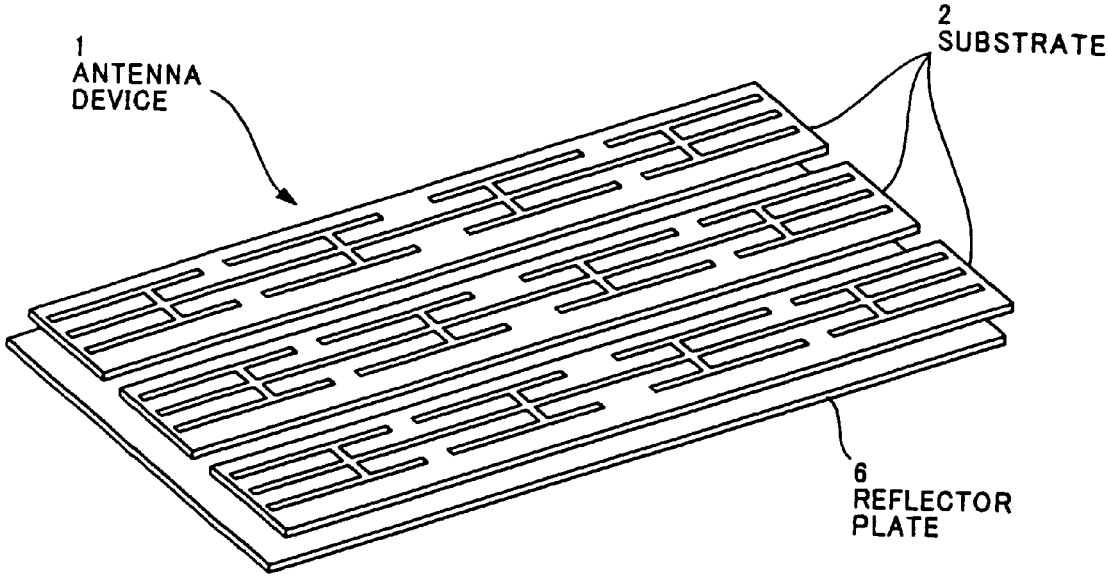

In an antenna device 1 shown in FIG. 12 or FIG. 13, a plurality of substrates 2 are disposed wherein the respective substrates 2 are parallel to each other, and an angle of each substrate 2 with a reflector plate 6 is the same as that in any of them. As in these examples of FIGS. 12 and 13, when a plurality of substrate type antennas 10 are set up so as to obtain an elliptical directivity in the horizontal plane and further, the reflector plate 6 is disposed, desired directivities in the horizontal planes shown in FIGS. 7, 10, 11 and the others can be achieved, respectively.

In these cases, when it is adjusted in such that each of the substrate type antennas 10 radiates a different radio wave, it becomes possible to respond to a plurality of station wavenumbers by only a single antenna device according to the antenna device as shown in FIG. 12 or 13.

Fourth Embodiment

FIGS. 14A to 14F are views each showing an antenna device according to the fourth embodiment of the present invention wherein a plurality of reflector plates 6 are disposed with respect to one substrate type antenna 10.

In these circumstances, the respective reflector plates 6 are located so as to have a variety of angles of inclination with respect to a substrate 2. More specifically, one reflector plate 6 is disposed so as to have 90° angle of inclination with respect to the substrate 2, while other two reflector plates 6, 6 are disposed in parallel to the substrate 2 so as to be in contact with the opposite ends of the one reflector plate 6 in FIG. 14A.

Figure 14A:
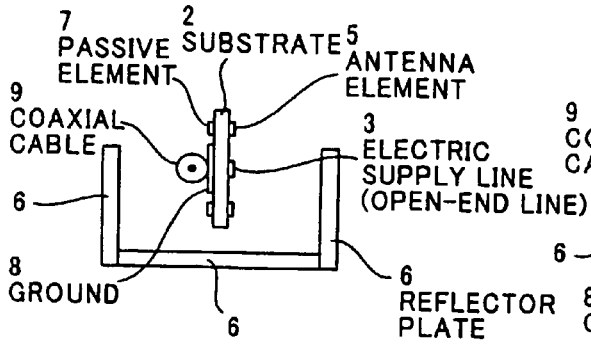
FIGS. 14A to 14F are side views each showing an antenna device according to a fourth embodiment of the present invention.
Figure 14B:
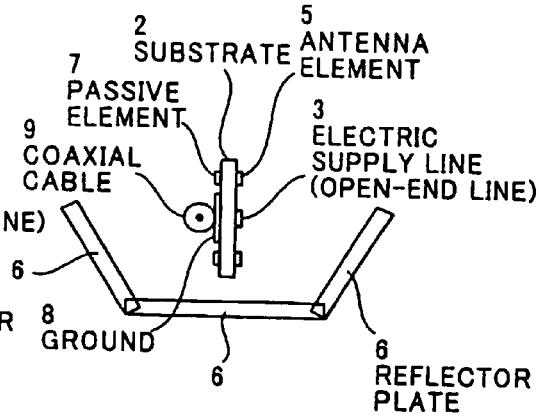

In FIG. 14B, one reflector plate 6 is disposed so as to have 90° angle of inclination with respect to a substrate 2, while other two reflector plates 6, 6 are disposed at about ±130° angles of inclination with respect to the substrate 2, respectively, so as to be in contact with the opposite ends of the reflector plate 6.

Figure 14C:
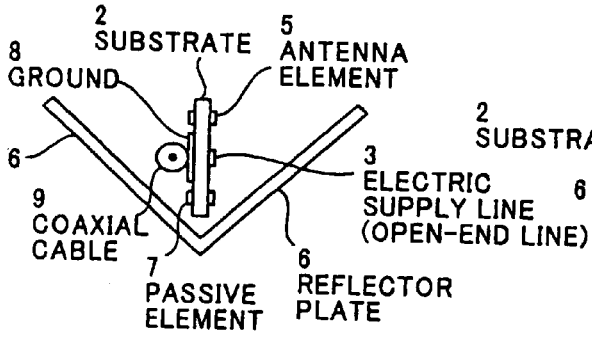

In FIG. 14C, two reflector plates 6 are disposed at about ±45° angles of inclination with respect to a substrate 2, respectively.

Figure 14D:
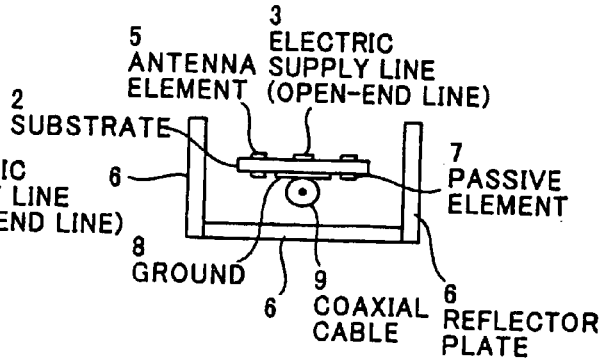

In FIG. 14D, one reflector plate 6 is disposed in parallel to a substrate 2, while other two reflector plates 6, 6 are disposed at 90° angles of inclination with respect to the substrate 2, respectively, so as to be in contact with the opposite ends of the one reflector plate 6.

Figure 14E:
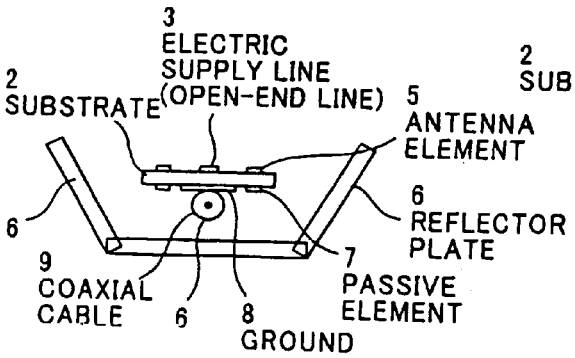

In FIG. 14E, one reflector plate 6 is disposed in parallel to a substrate 2, while other two reflector plates 6, 6 are disposed at about ±60° angles of inclination with respect to the substrate 2, respectively, so as to be in contact with the opposite ends of the one reflector plate 6.

Figure 14F:
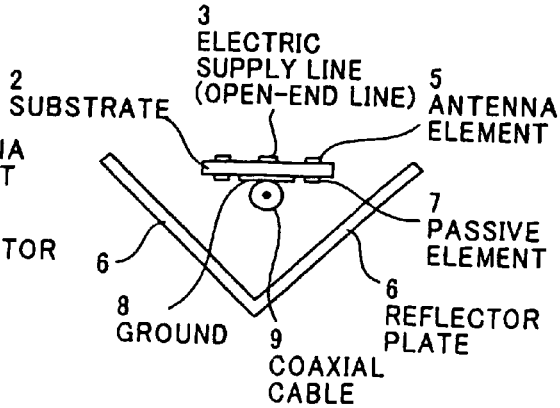

In FIG. 14F, two reflector plates 6, 6 are disposed at about ±45° angles of inclination with respect to a substrate 2, respectively.

Figure 15:
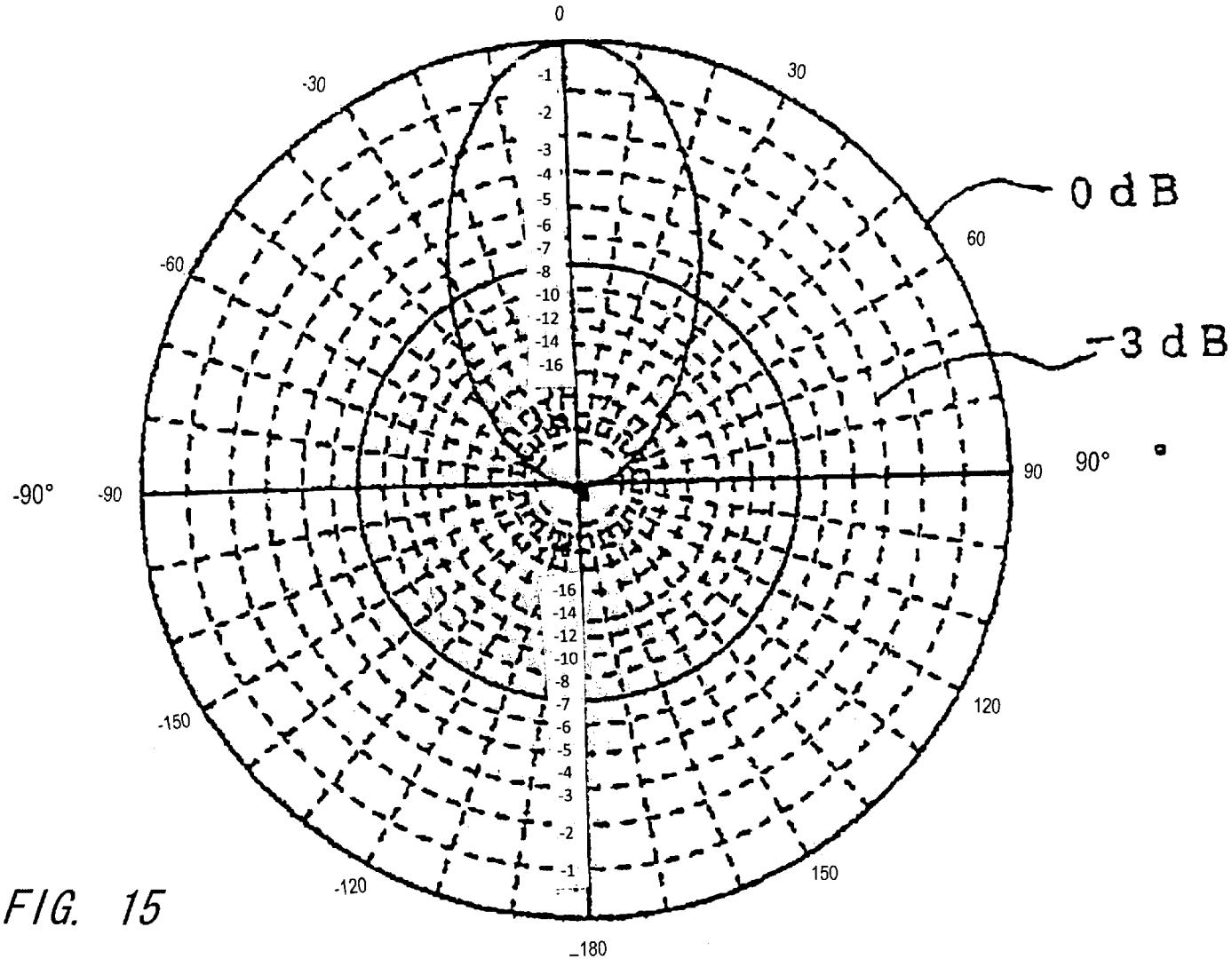
FIG. 15 is a characteristic diagram showing a directivity in the horizontal plane of the antenna device shown in FIG. 14F.
Figure 16A:
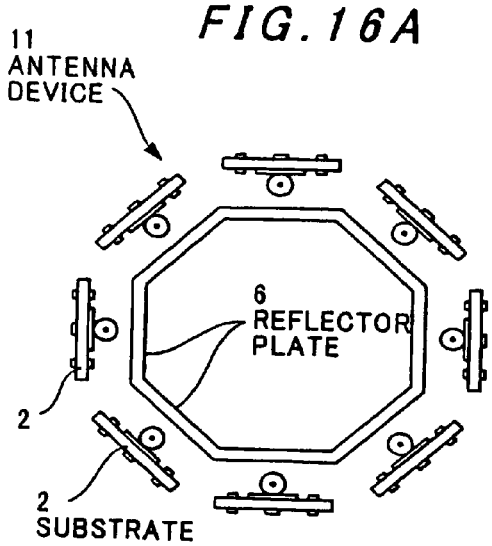
FIGS. 16A to 16D are side views each showing an antenna device according to a fifth embodiment of the present invention.
Figure 16B:
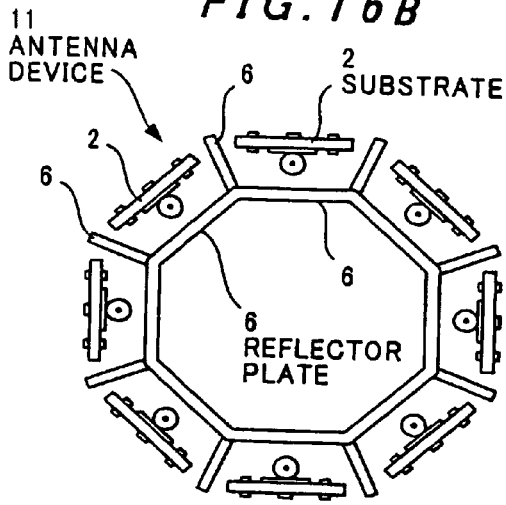
Figure 16C:
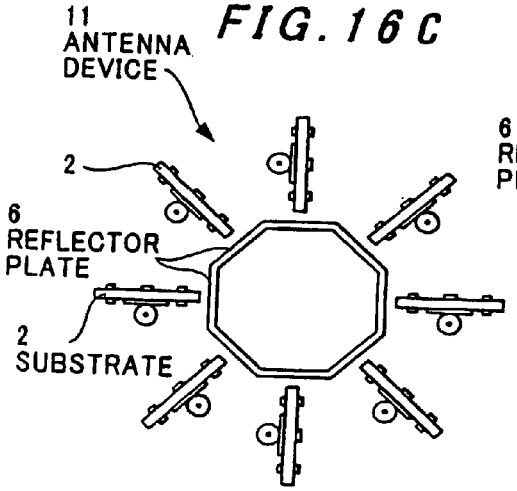
Figure 16D:
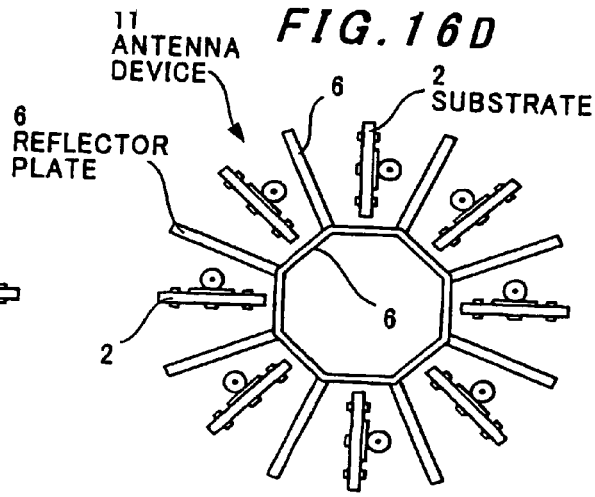

FIG. 15 shows a directivity in the horizontal plane of the antenna device 1 shown in FIG. 14F wherein when an angle at which −3 dB gain is attained is observed on the basis of a gain of 0° at which the maximum gain is achieved, it is ±25°, namely 50° directivity angle is obtained. As described above, when a configuration of the reflector plates 6 is modified, directivity angle can be easily adjusted.

Fifth Embodiment

FIGS. 16A to 16D show antenna devices 11 each of which is arranged by employing a plurality of reflector plates 6 as shown in FIGS. 3, 8 and others. These reflector plates 6 are disposed at a predetermined crossed axes angle, respectively, so as to configure a polygonal figure in the horizontal plane, and the same number of substrates 2 as that of the reflector plates 6 are disposed in such that each of the substrates 2 is located with respect to each of the corresponding reflector plates 6 at an equal angle of inclination. Since a set of such antenna device 11 composed of a pair of the substrate 2 and the reflector plate 6 has a directivity angle of a narrow directivity in the horizontal plane, it is suitable for applying the antenna device 11 wherein a plurality of the antenna devices 1 are disposed at the same place to such purpose for dividing a service area 202 into narrower regions as in the case of FIG. 2B or 2C by means of each directivity of the antenna devices 1.

Sixth Embodiment

An angle of inclination $\alpha$ in the reflector plate 6 may be selected to any value in 360° with respect to the substrate 2.

Figure 17:
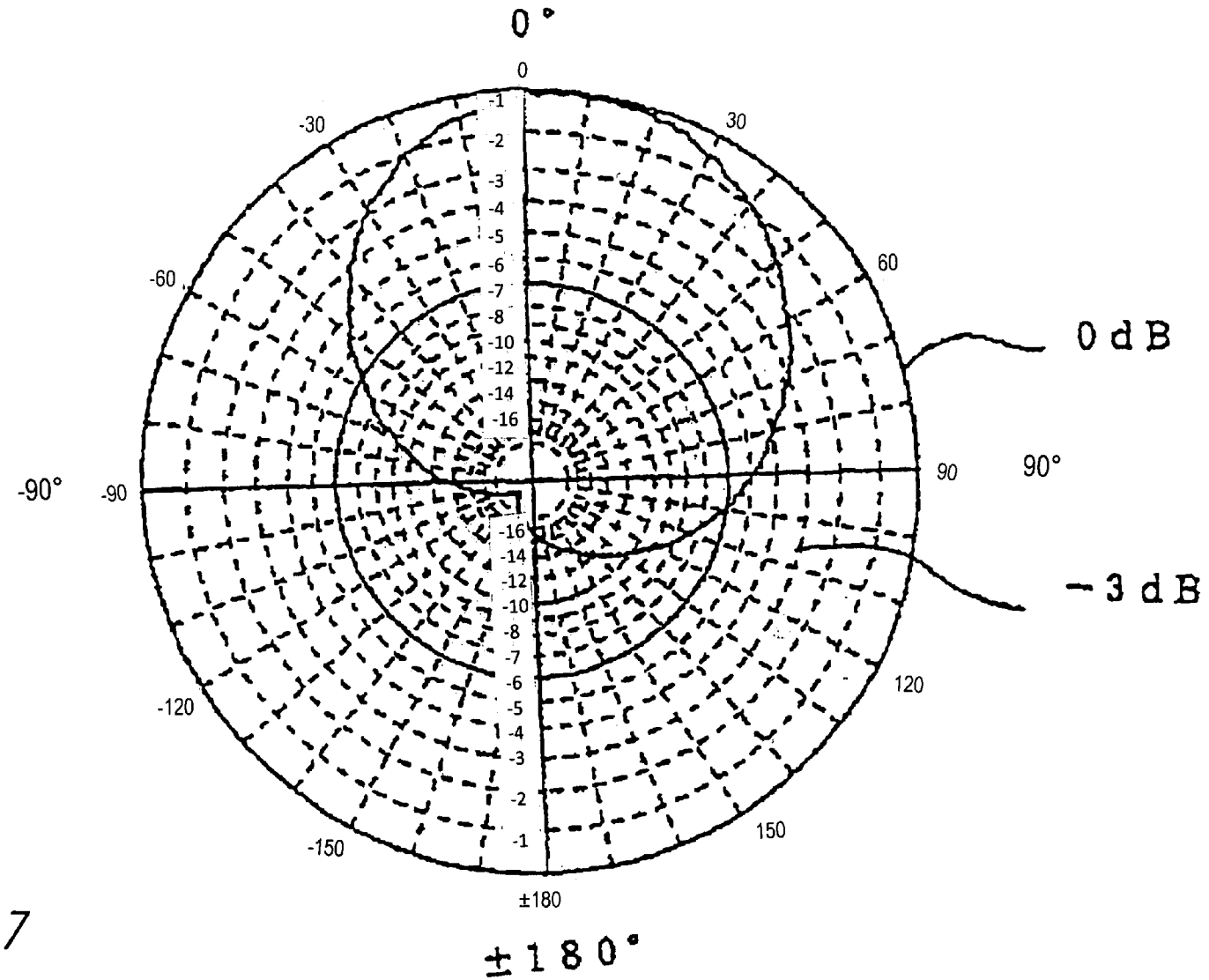
FIG. 17 is a characteristic diagram showing a directivity in the horizontal plane of the antenna device shown in FIG. 3 wherein an angle of inclination $\alpha$ of the antenna is 45° according to a sixth embodiment of the present invention.

FIG. 17 shows a directivity in the horizontal plane in the case where the angle of inclination $\alpha$ is +45° wherein an angle at which a gain becomes the maximum deviates by about 10°, and an angle at which −3 dB is attained is −40° and +70°, respectively, as shown in the figure, whereby it is understood that the directivity is shifted totally to the +angle side.

Figure 18:
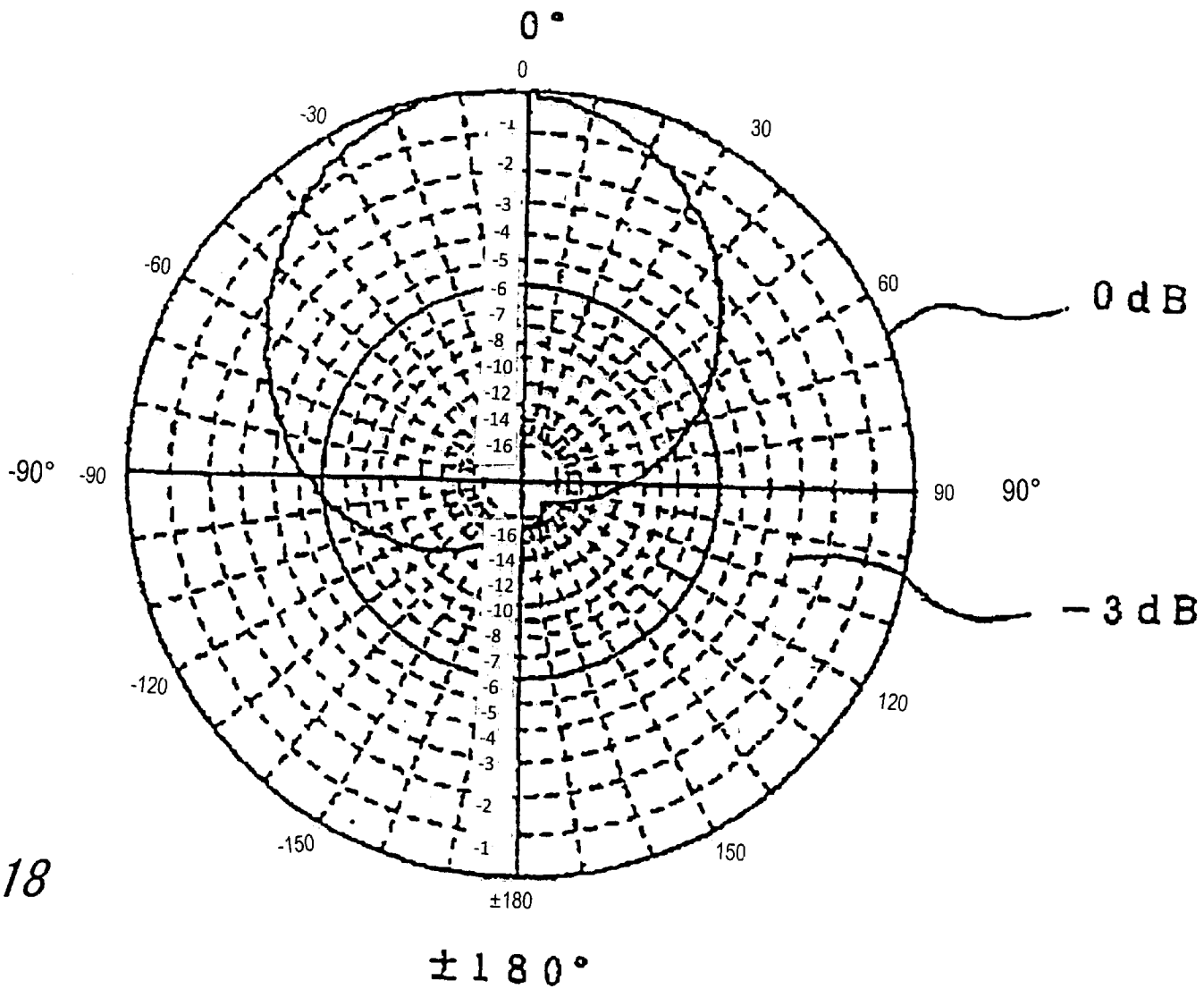
FIG. 18 is a characteristic diagram showing a directivity in the horizontal plane of the antenna device shown in FIG. 3 wherein an angle of inclination $\alpha$ of the antenna is −45° according to the sixth embodiment of the present invention.

FIG. 18 shows a directivity in the horizontal plane in the case where an angle of inclination $\alpha$ is −45° wherein an angle at which a gain becomes the maximum deviates by about −10°, and an angle at which −3 dB is attained is +40° and −70°, respectively, as shown in the figure, whereby it is found that the directivity is shifted totally to the −angle side.

As is understood from the characteristics shown in FIGS. 17 and 18, when the angle of inclination α of a reflector plate 6 is changed with respect to a substrate 2, an orientation of directivity can be changed. On one hand, when a distance extending from the reflector plate 6 to the substrate 2 is changed, an orientation of directivity can be also changed.

Based on the above description, embodiments of a multi-directivity substrate type antenna according to the present invention will be further described.

Seventh Embodiment

Figure 19:
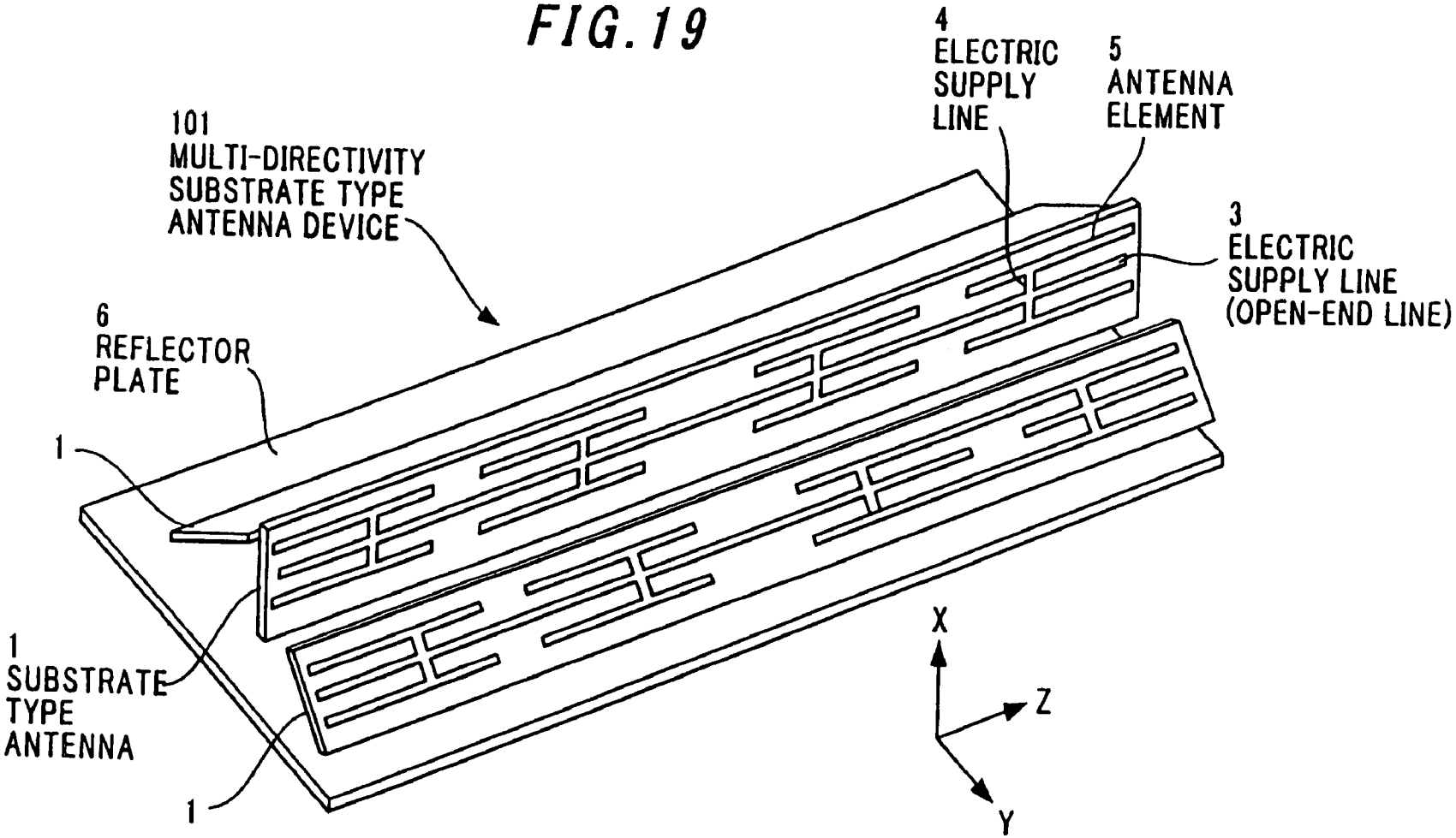
FIG. 19 is a perspective view showing a multi-directivity substrate type antenna according to a seventh embodiment of the present invention.

As shown in FIG. 19, a multi-directivity substrate type antenna device 101 is prepared by such a manner that first, a substrate type antenna 1 is obtained by forming electric supply lines 3 and 4 each composed of microstrip lines, and antenna elements 5 each composed of microstrip lines on a substrate 2; a plurality of the resulting substrate type antennas 1, each of which is disposed in such that the longitudinal direction of the substrate 2 is made to be vertical with respect to the horizontal plane, is aligned in a row with a distance along the horizontal direction; and a reflector plate 6 is located in the aligned direction of the substrate type antennas 1. Besides, angles of inclination in the horizontal planes of the respective substrates 2 are allowed to differ in every antennas 1 with respect to the reflector plate 6.

As explained in FIGS. 17 and 18, an orientation of a directivity in the substrate type antenna 1 changes due to an angle of inclination α of the reflector plate 6 with respect to the substrate 2. Accordingly, the antenna device 101 shown in FIG. 19 has such characteristics obtained by overlapping directivities of the respective substrate type antennas 1 with each other.

Eighth Embodiment

Figure 20:
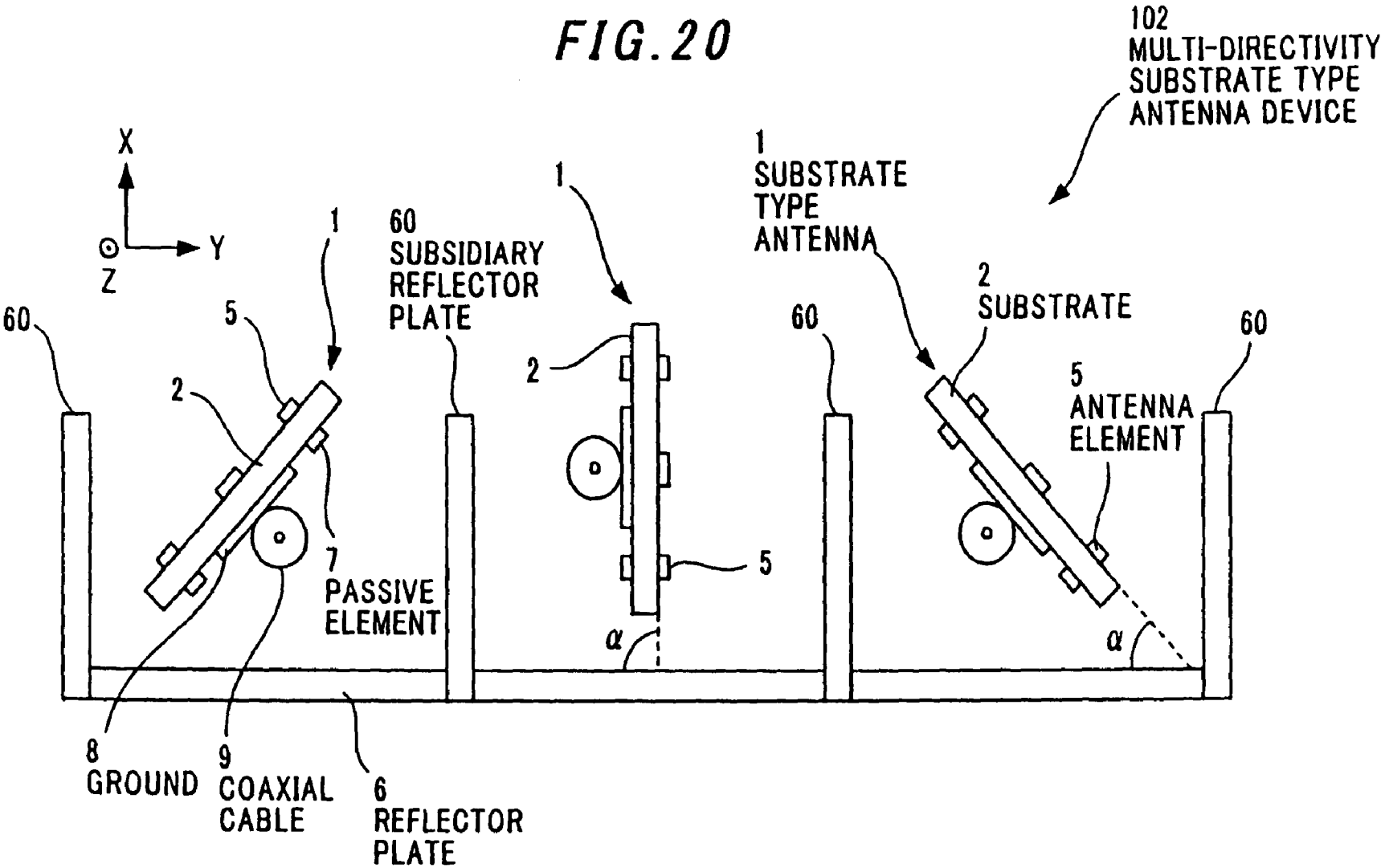
FIG. 20 is a side view showing a multi-directivity substrate type antenna according to an eighth embodiment of the present invention.

As shown in FIG. 20, a multi-directivity substrate type antenna device 102 is provided with a plurality of subsidiary reflector plates 60 wherein each of the subsidiary reflector plates 60 is perpendicular to a reflector plate 6, and one end of each subsidiary reflector plate 60 is disposed so as to be in contact with the reflector plate 6. In FIG. 20, the reflector plate 6 is sectioned with a predetermined distance, so that one end of each subsidiary reflector plate 60 is sandwiched in between sectioned pieces of the reflector 6. The subsidiary reflector plates 60 are disposed at the opposite ends of the reflector plate 6 as well as at each intermediate position in between dispositions of the substrate type antennas 1. Thus, each substrate 2 in the respective substrate type antennas 1 is sandwiched in between two subsidiary reflector plates 60, respectively.

In the antenna device 102 shown in FIG. 20, three substrate type antennas 1 are located so as to have a different angle of inclination α with respect to the reflector plate 6, respectively. Each angle of inclination α of a surface in a substrate type antenna 1 on which antenna elements 5 are disposed with the reflector plate 6 is about 45° in the substrate type antenna 1 on the right side, 90° in the substrate type antenna 1 in the central region, and −45° in the substrate type antenna 1 on the left side of the drawing.

Ninth Embodiment

Figure 21:
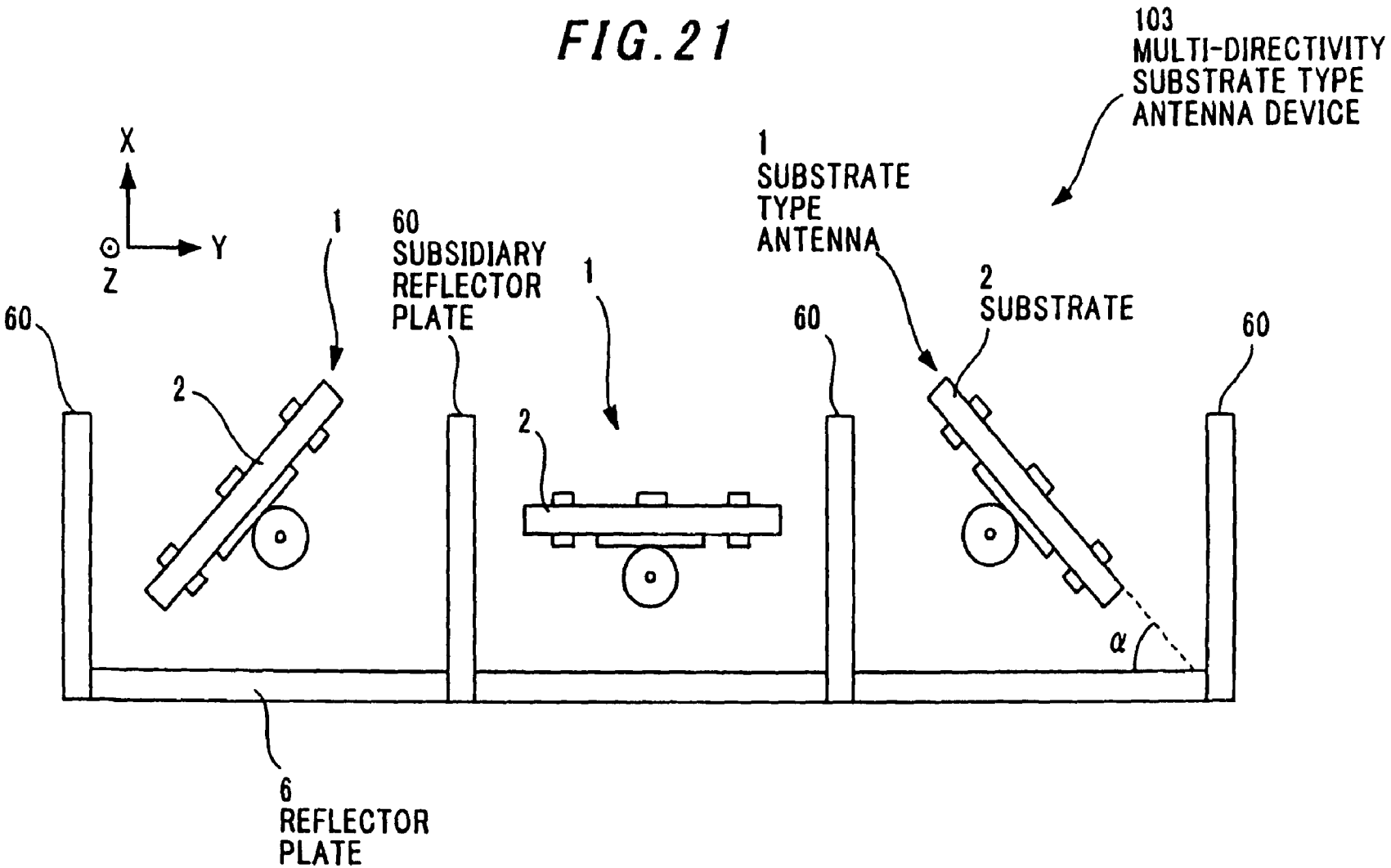
FIG. 21 is a side view showing a multi-directivity substrate type antenna according to an ninth embodiment of the present invention.

In an antenna device 103 shown in FIG. 21, each angle of inclination α in each substrate type antenna 1 of the antenna device 102 of FIG. 20 is changed. Namely, an angle of inclination α of a substrate type antenna 1 in the central region is 0°, while each angle of inclination α in substrate type antennas 1 on the right and left sides of the drawing is 45° and −45°.

Figure 22:
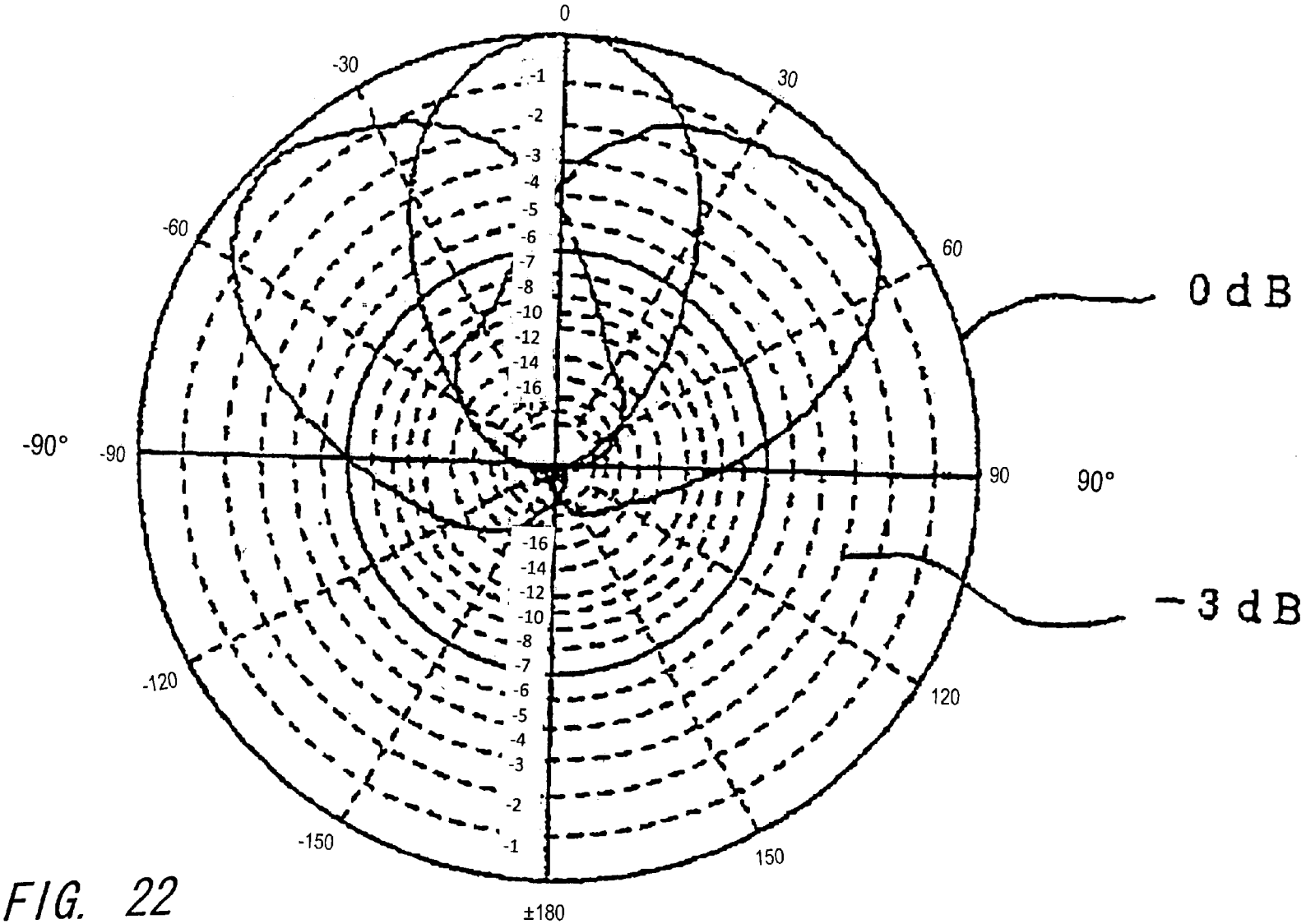
FIG. 22 is a characteristic diagram showing a directivity in the horizontal plane of the antenna device shown in FIG. 21.

FIG. 22 shows a directivity in the horizontal plane of the antenna device 103 shown in FIG. 21. From FIG. 22, it is found that the antenna device 103 has directivity angles of about 60°, respectively, and has three different directivities at which each of the maximum gains is obtained along the directions of about 45°, 0°, and −45°, respectively. These three directivities correspond to those of the substrate type antennas 1 shown in FIGS. 14A to 14F, respectively. In the respective substrate type antennas 1, when values of angles of inclination α, or dimensions of reflector plates 6 or subsidiary reflector plates 60, and relative positions among the reflector plates 6, the subsidiary reflector plates 60, and substrates 2 are adjusted, directivity angles and directions along which the maximum gains are achieved, respectively, may be suitably changed.

As described above, since a plurality of substrate type antennas 1 aligned in a row is disposed so as to have different angles of inclination α with respect to the reflector plate 6 in the above-described seventh to ninth embodiments, directivities derived from the respective substrate type antennas 1 and the reflector plate 6 may be overlapped with each other to realize multi-directivity thereof.

These antenna devices 101 to 103, inclusive, have a two-dimensional structure wherein a plurality of the substrate type antennas 1 is aligned along the reflector plate 6 with each other. Accordingly, these antenna devices 101 to 103 have simpler structures and smaller spaces (volume) occupied by their components than that of the case where individual antennas each having the same directivity are located in different directions, respectively. Even in a case where each directivity angle of an individual antenna makes further smaller and increases further more of the number of such individual antennas, the number of the substrate type antennas 1 to be aligned along the reflector plate 6 increases simply, the structure itself is not complicated in the present invention.

Tenth Embodiment

Figure 23:
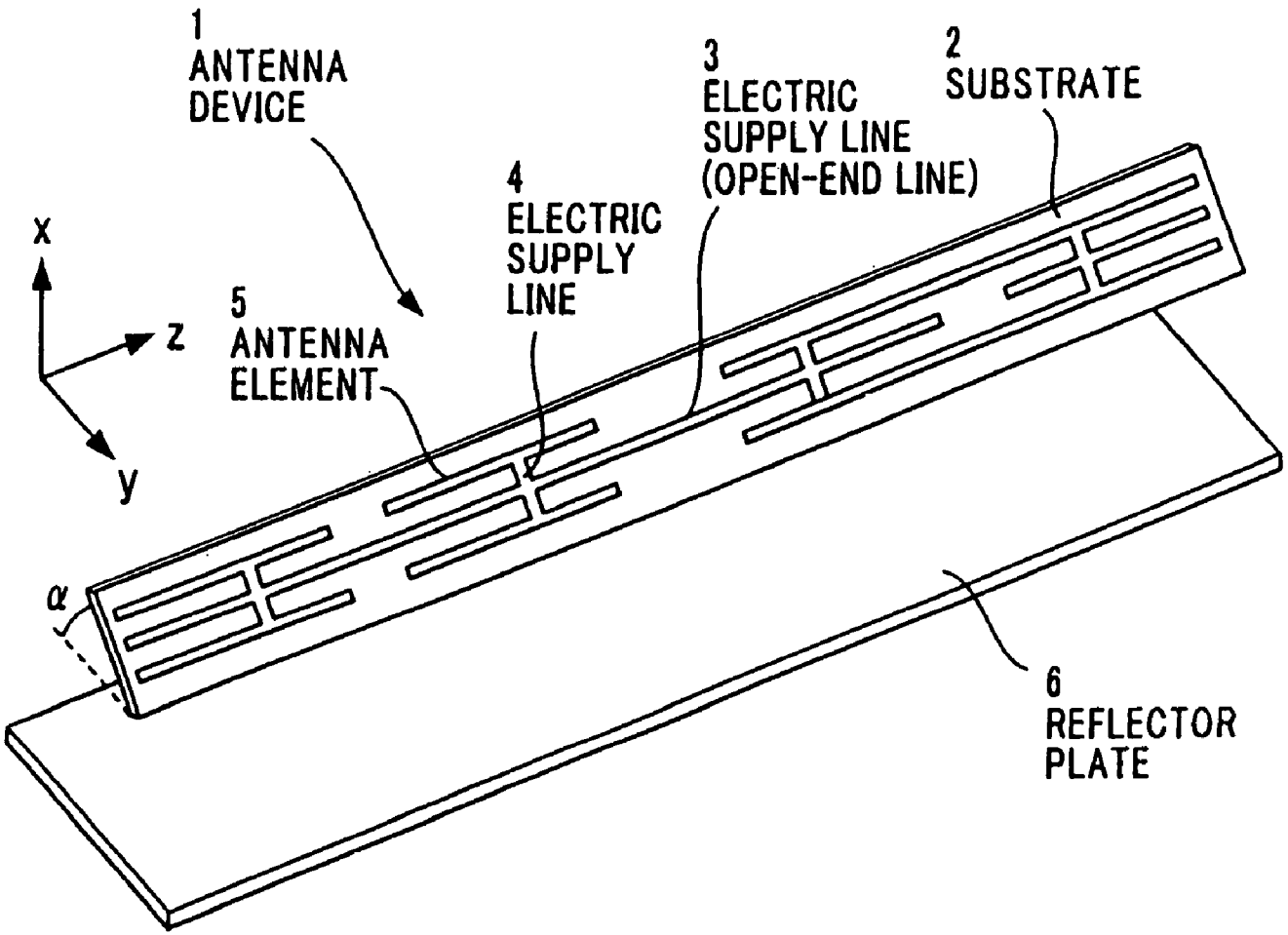
FIG. 23 is a perspective view showing a substrate type antenna device according to a tenth embodiment of the present invention.
Figure 24:
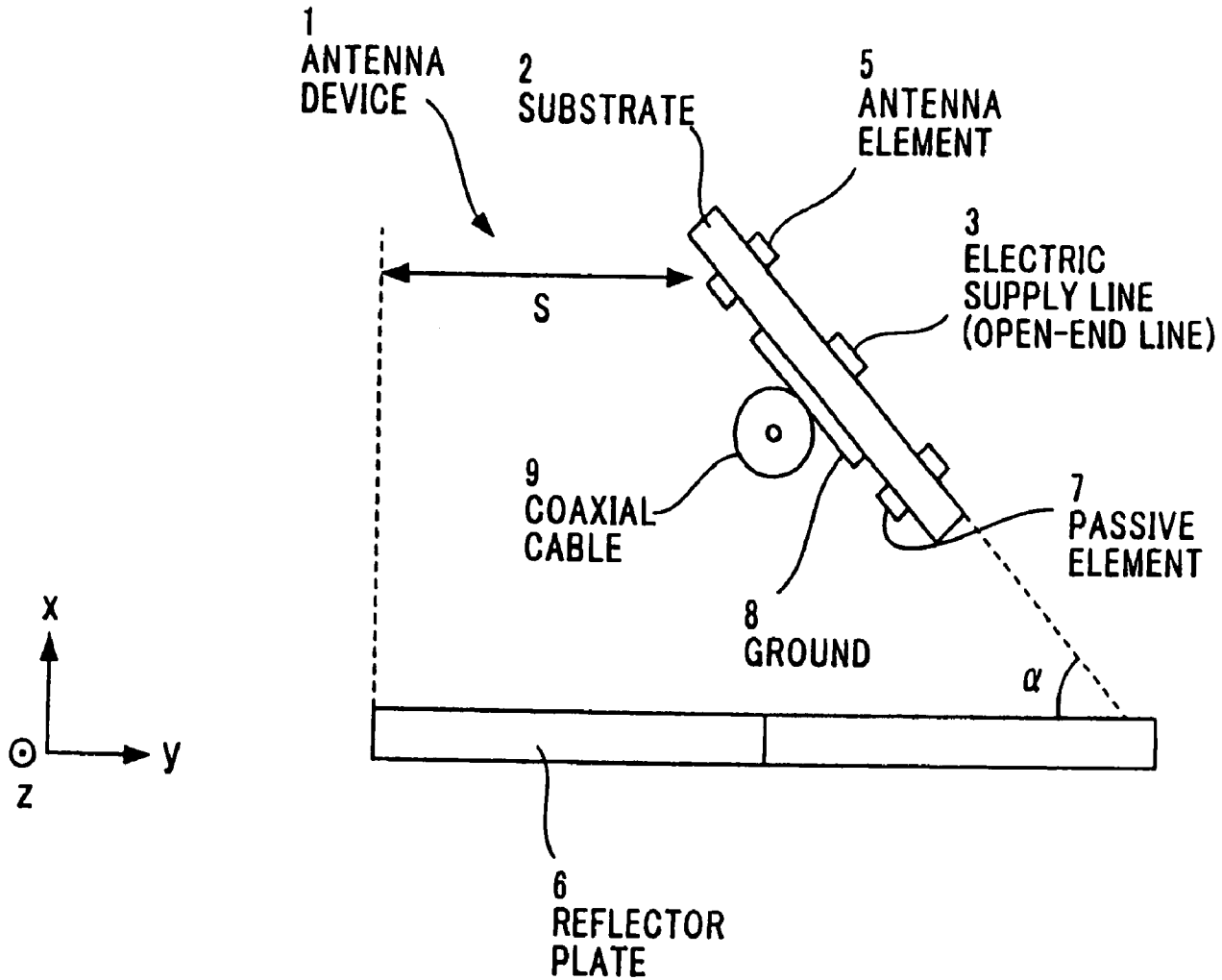
FIG. 24 is a side view showing the substrate type antenna device shown in FIG. 23.

As shown in FIGS. 23 and 24, an antenna device 1 of the tenth embodiment is constructed in such that a reflector plate 6 is positioned so as to have a predetermined angle of inclination in the horizontal plane with respect to a substrate 2, and the reflector plate 6 is made to be relatively movable with respect to the substrate 2 while maintaining the above-described angle of inclination. In the tenth embodiment, although the angle of inclination α is 45°, any degree of angle may be selected for obtaining a desired directivity.

In FIGS. 23 and 24, the reflector plate 6 is in its initial position wherein the reflector plate 6 is set up optionally apart from the substrate 2.

Figure 25:
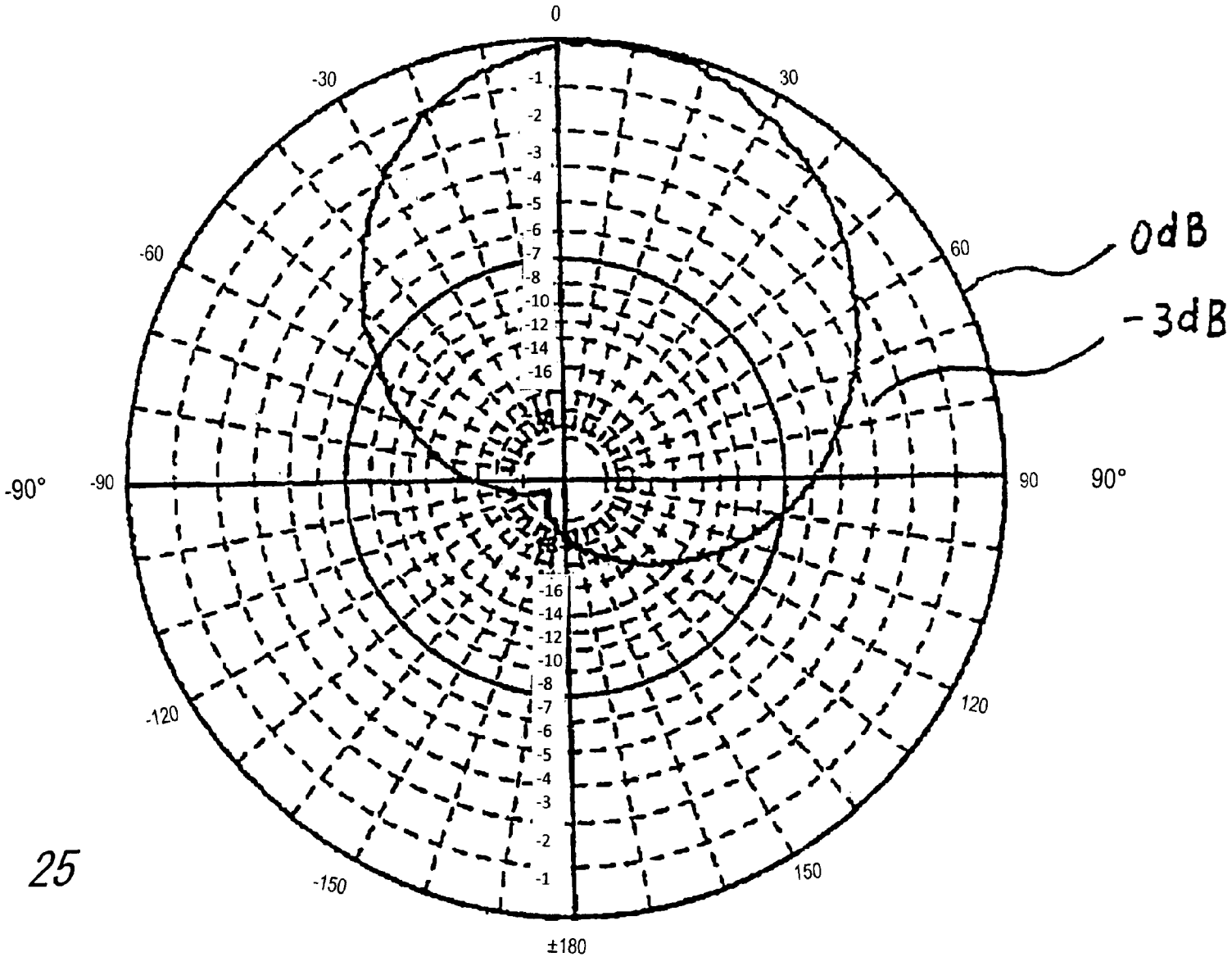
FIG. 25 is a characteristic diagram showing a directivity in the horizontal plane of the substrate type antenna device shown in FIG. 23 (an angle of inclination $\alpha$ of the antenna is 45°)

FIG. 25 shows a directivity in the horizontal plane in the case when the angle of inclination α is 45° in the antenna device 1. As is apparent from FIG. 25, an angle at which the maximum gain is achieved deviates by about 10° from the vertical line, while an angle at which −3 dB is obtained is −40° and +70°, whereby it is found that the directivity shifts totally to the +angle side.

Eleventh Embodiment

In the present embodiment, an offset S (a distance between an end of the substrate 2 and the reflector plate 6 in the y-axis direction of the antenna device 1 shown in FIGS. 23 and 24 is called by the name of "offset S") is changed by moving a reflector plate 6.

Figure 26:
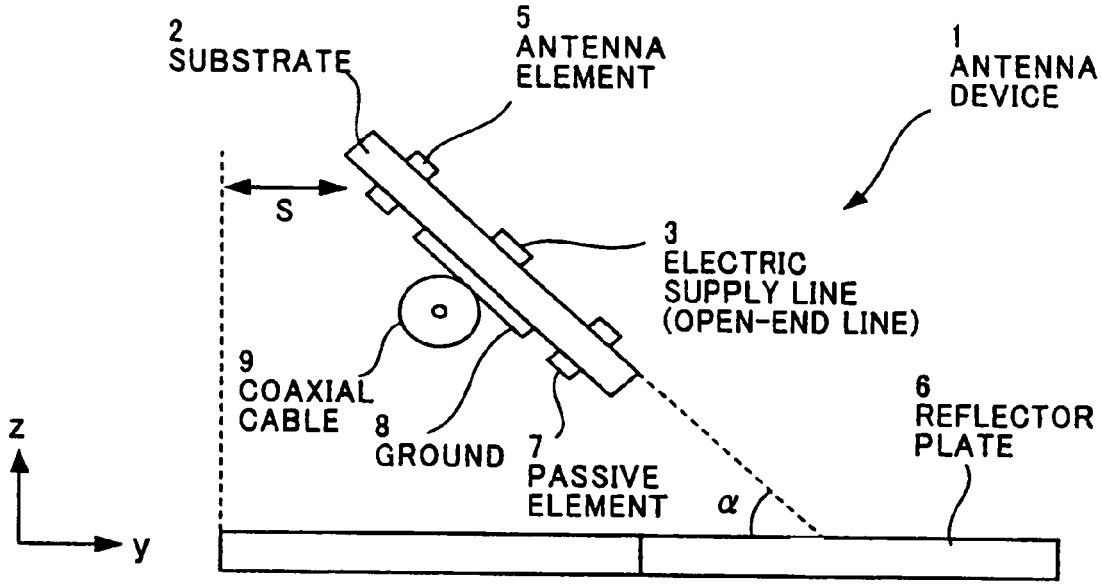
FIG. 26 is a side view showing a substrate type antenna device according to an eleventh embodiment of the present invention wherein a reflector plate of the antenna device of FIG. 24 is shifted.

FIG. 26 shows a situation wherein the reflector plate 6 in the antenna device 1 of FIG. 24 is shifted. In FIG. 24, although a central position in the width direction of the substrate 2 and a central position in the width direction of the reflector plate 6 are at the same position along the y-axis, while the substrate 2 is shifted relatively to the minus direction of the y-axis, so that the offset S decreases in FIG. 26.

In this case, although it is sufficient to shift relatively the substrate 2 and the reflector plate 6, only the reflector plate 6 is shifted herein because of such reasons that since a coaxial electric supply line 9 is attached and wired to the substrate 2, it is difficult to shift the substrate 2, and that directivities are compared on the basis of the substrate 2 as the starting point.

Figure 27:
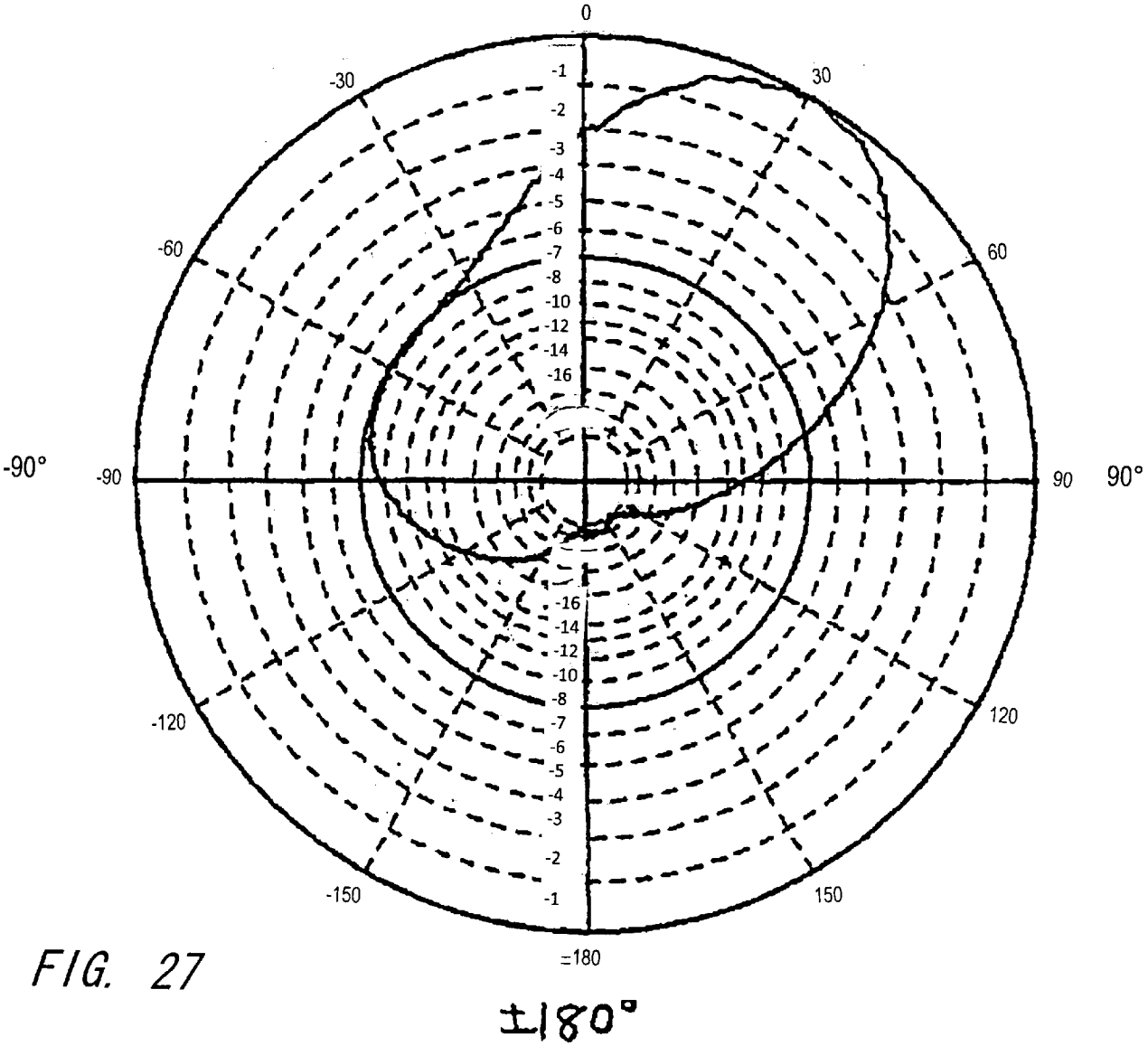
FIG. 27 is a characteristic diagram showing a directivity in the horizontal plane of the antenna device shown in FIG. 26.

FIG. 27 shows a directivity in the horizontal plane of the antenna device 1 shown in FIG. 26 wherein an angle at which the maximum gain is obtained deviates by about 30° from the vertical line, and hence it is found that the directivity shifts totally to the +angle side as compared with the result of FIG. 25. As described above, when the offset S is changed simply from the situation of FIG. 24 to that of FIG. 26, their directivities can be scanned.

Twelfth Embodiment

Figure 28:
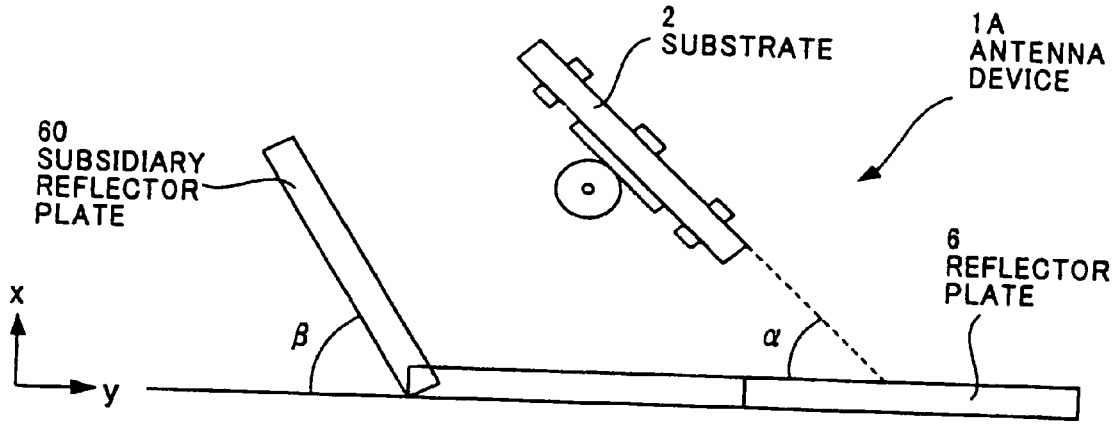
FIG. 28 is a side view showing a substrate type antenna device according to a twelfth embodiment of the present invention.

An antenna device 1A shown in FIG. 28 is obtained by adding another reflector plate (subsidiary reflector plate) 60 to the antenna device 1 of FIG. 26 wherein the subsidiary reflector plate 60 is allowed to have an angle of inclination in the horizontal plane different from the angle of inclination $\alpha$ in the reflector plate 6 of FIG. 26 with respect to a substrate 2. In this case, an angle $\beta$ of the subsidiary reflector plate 60 with a reflector plate 6 is selected to make the former angle of inclination with respect to the substrate 2 different from the latter angle of inclination $\alpha$. The subsidiary reflector plate 60 is provided integrally with the reflector plate 6, and it is shifted together with the reflector plate 6.

Figure 29:
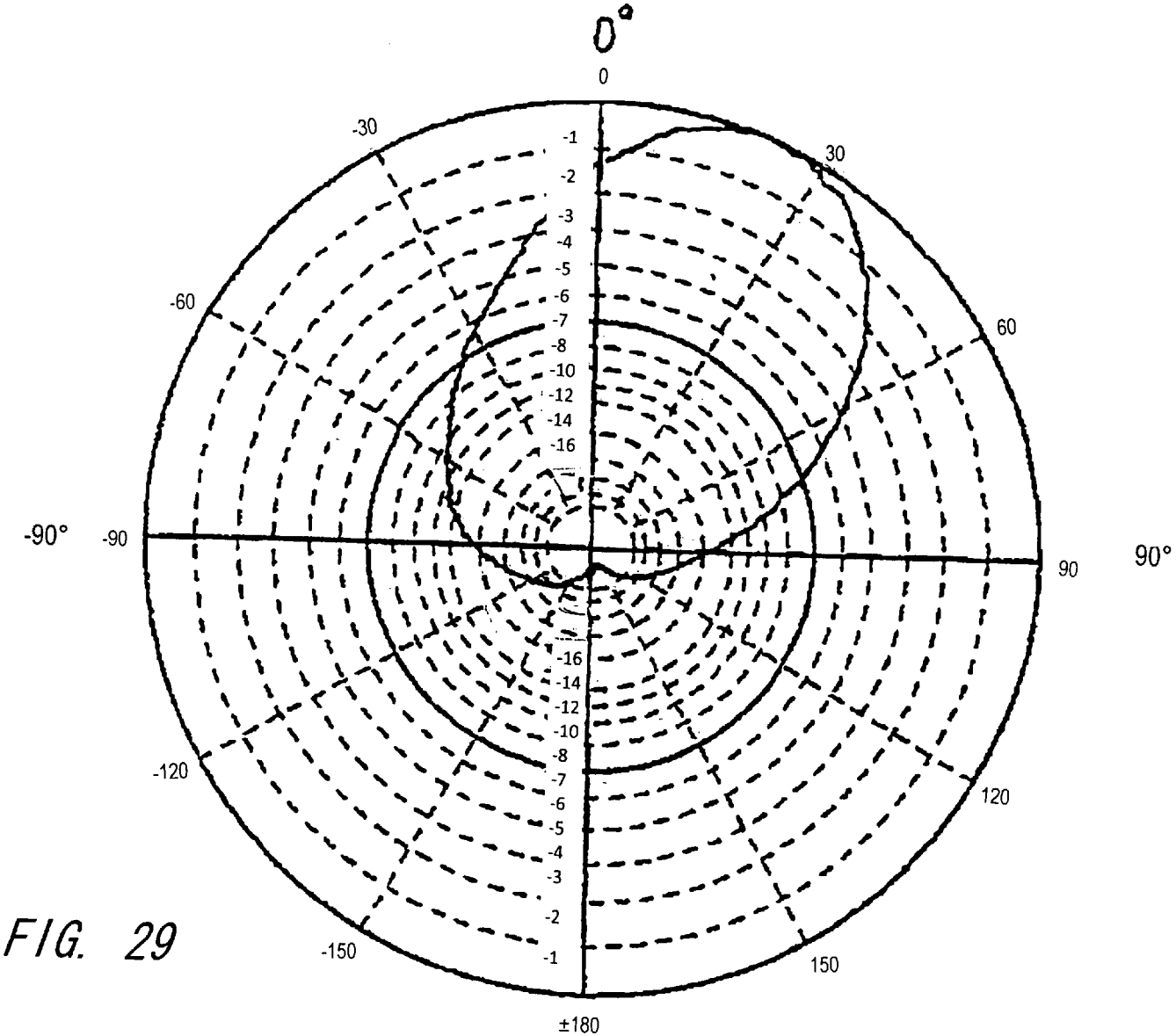
FIG. 29 is a characteristic diagram showing a directivity in the horizontal plane of the antenna device shown in FIG. 28.

FIG. 29 shows a directivity in the horizontal plane of the antenna device 1A of FIG. 28 wherein it is not different from FIG. 27 in that an angle at which the maximum gain is attained is about 30°, but no side lobe is observed in the present embodiment of FIG. 29 unlike the case of FIG. 27 where a side lobe appears at −60°.

Thirteenth Embodiment

Figure 30:
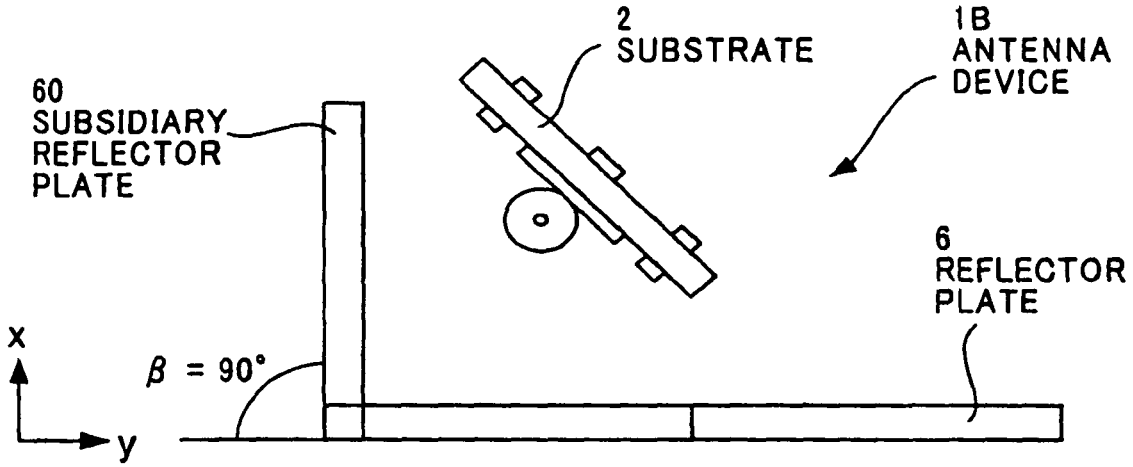
FIG. 30 is a side view showing a substrate type antenna device according to a thirteenth embodiment of the present invention.

An antenna device 1B shown in FIG. 30 is prepared by adding another subsidiary reflector plate 60 to the antenna device 1 of FIG. 26 wherein an angle $\beta$ of the subsidiary reflector plate 60 with the reflector plate 6 differs from that of the antenna device 1A of FIG. 28, and it is 90° in the present embodiment.

Figure 31:
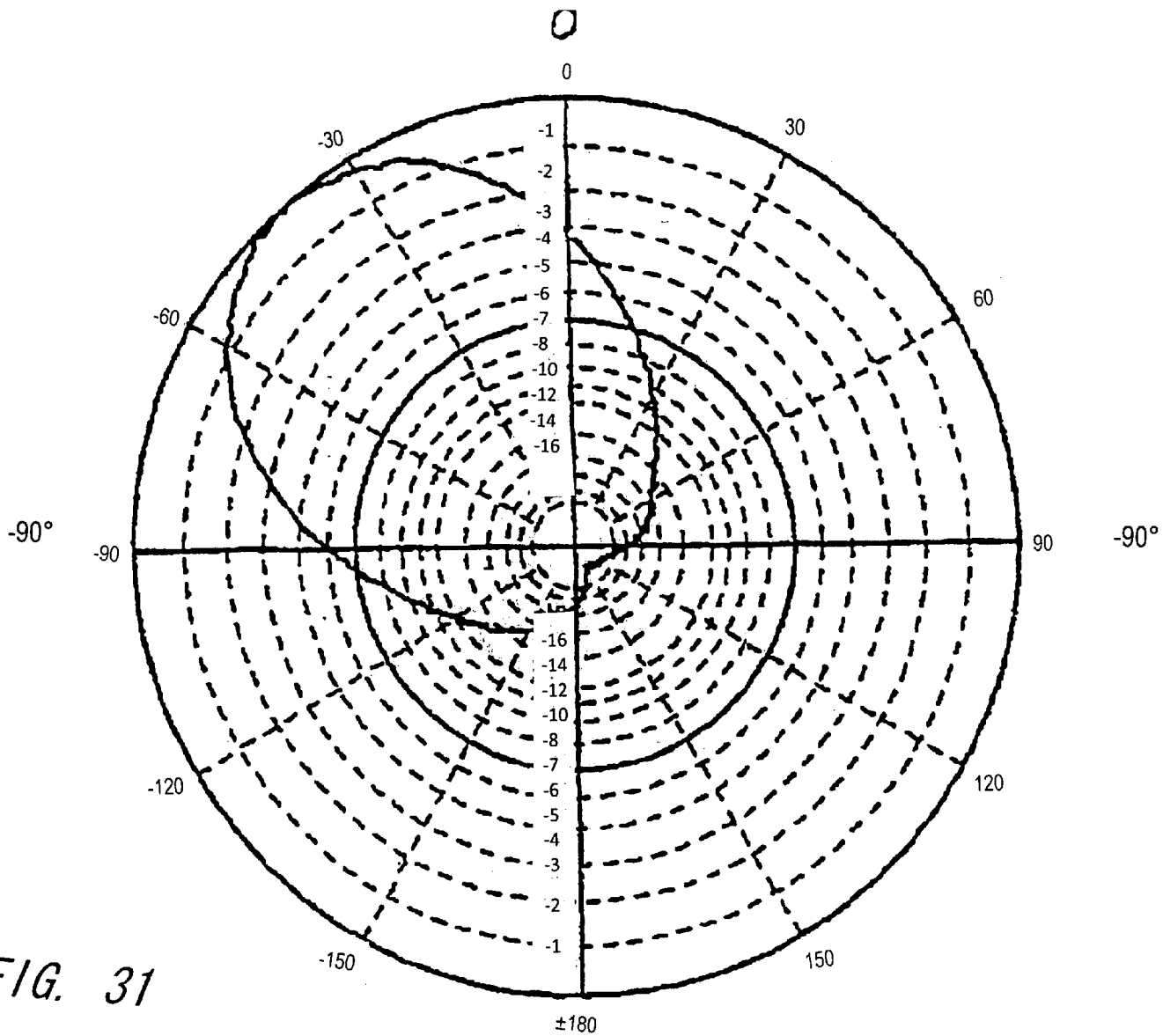
FIG. 31 is a characteristic diagram showing a directivity in the horizontal plane of the antenna device shown in FIG. 30.

FIG. 31 shows a directivity in the horizontal plane of the antenna device 1B shown in FIG. 30 wherein it is not different from those of FIGS. 27 and 29 in that an angle at which the maximum gain is achieved is about 30°, but no side lobe is observed in FIG. 31, so that such ideal profile that an angle at which −3 dB is attained is 0° and +60° is obtained.

Fourteenth Embodiment

As is apparent from the above description, when an offset S defined between a substrate 2 and a reflector plate 6 is changed simply, a directivity to be obtained may be scanned in the present invention.

Figure 32:
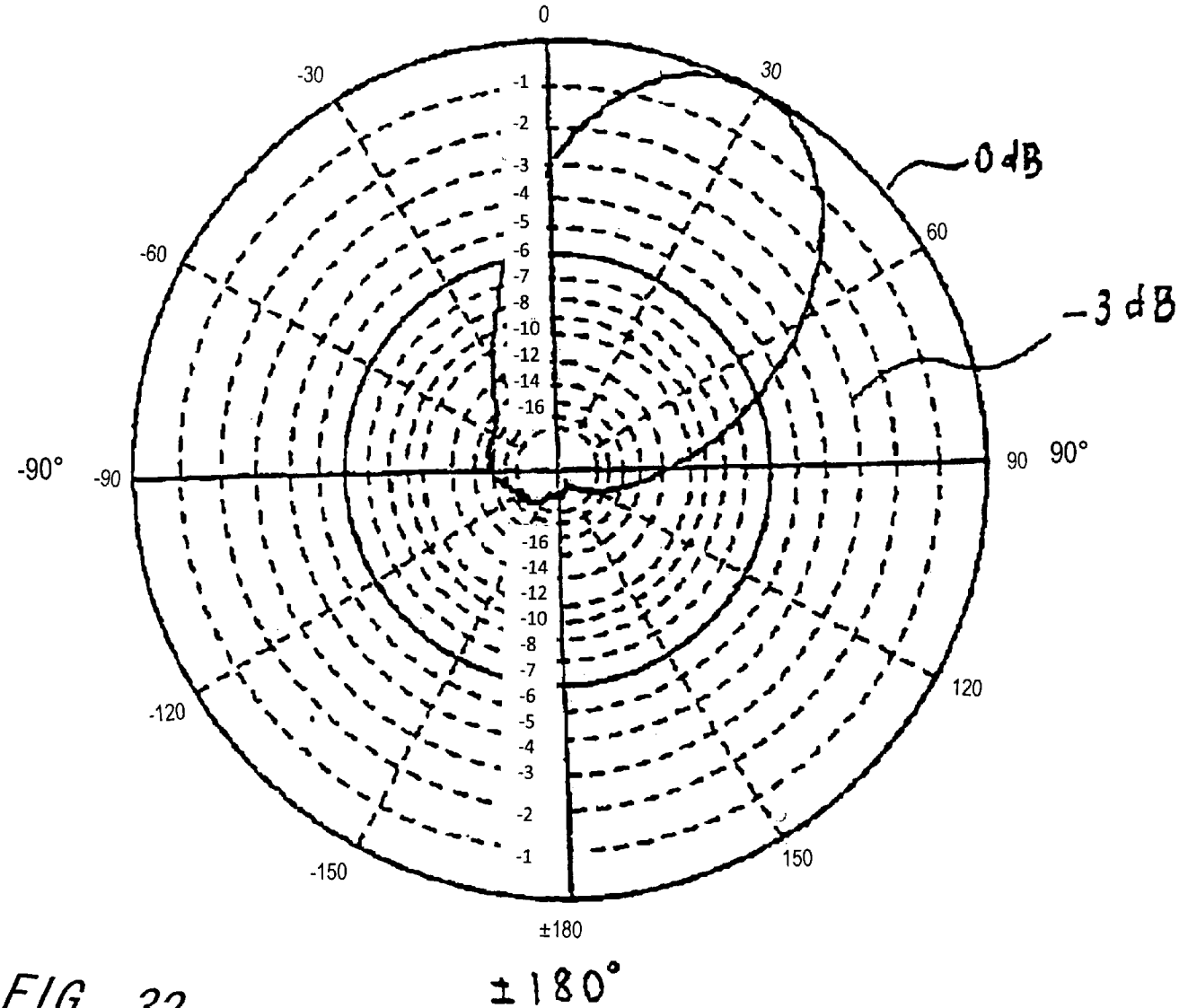
FIG. 32 is a characteristic diagram showing a directivity in the horizontal plane of the antenna device according to a fourteenth embodiment of the present invention.

The reflector plate 6 may be shifted continuously or in a step-by-step manner. When the reflector plate 6 (or the subsidiary reflector plate 60 and the reflector plate 6) is (are) shifted by a suitable distance, a directivity in a desired orientation, for example, a directivity with −45° angle at which the maximum gain is attained can be realized as shown in FIG. 32. Unlike a conventional mechanical scan antenna, the antenna device according to the present invention is neither required to move a whole antenna device including a radiator, nor to add complicated circuit elements unlike an electronic scan antenna. Besides, since the antenna device of the invention is sufficient to shift only the reflector plate 6 along a uniaxial direction, a required shifting mechanism can be simply constructed. More specifically, a scannable substrate type antenna can be manufactured inexpensively in a compact and simple structure according to the present invention.

Fifteenth Embodiment

Figure 33:
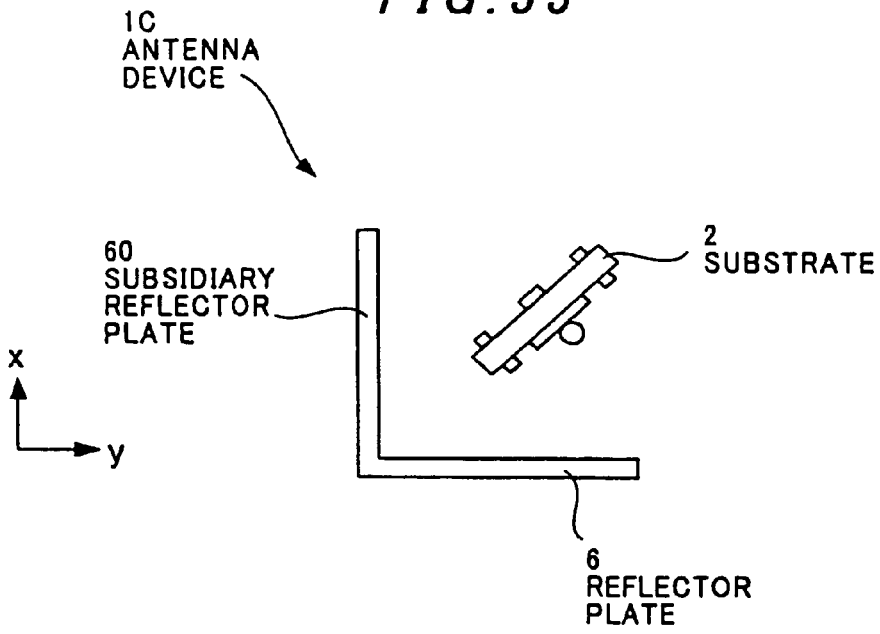
FIG. 33 is a side view showing a substrate type antenna device according to a fifteenth embodiment of the present invention.

A size of a reflector plate 6 or a subsidiary reflector plate 60 may be suitably adjusted in view of a profile in directivity. For instance, an antenna device 1C shown in FIG. 33 contains a reflector plate 6 having a narrower width than that of the antenna device 1B shown in FIG. 30, while a subsidiary reflector plate 60 having a wider width than that of the antenna device 1B of FIG. 30.

Sixteenth Embodiment

Figure 34:
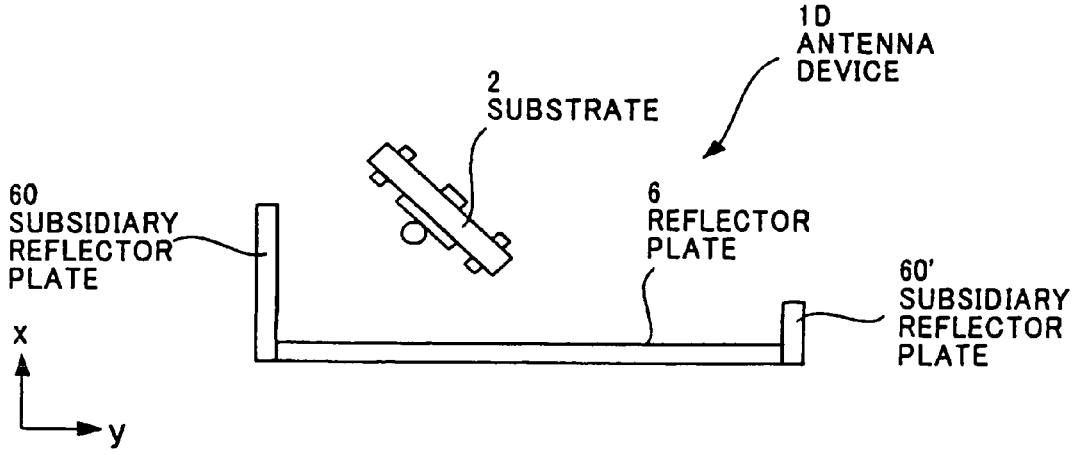
FIG. 34 is a side view showing a substrate type antenna device according to a sixteenth embodiment of the present invention.

A subsidiary reflector plate 60 may be attached to the opposite ends of the reflector plate 6. In an antenna device 1D shown in FIG. 34, subsidiary reflector plates 60 and 60' are positioned on the opposite ends of a reflector plate 6, which has an angle of inclination $\alpha$ with respect to a substrate 2, at both the angles $\beta$=90°, respectively. In the case when a plurality of subsidiary reflector plates 60 are provided, each of the subsidiary reflector plates 60, and 60' may be differed with each other as described above.

Seventeenth Embodiment

A mechanism for shifting a reflector plate will be described in the present embodiment.

Figure 35:
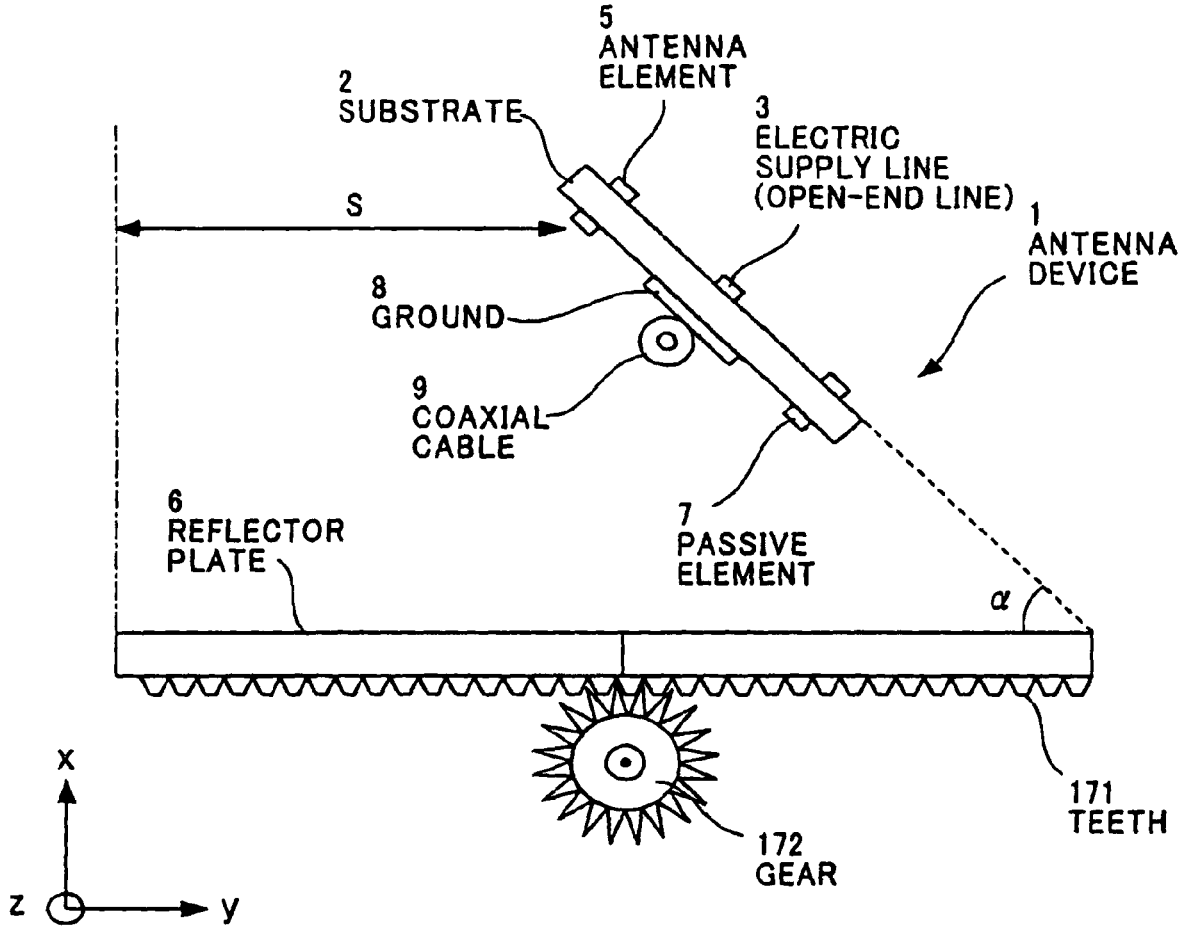
FIG. 35 is a side view showing a substrate type antenna device according to a seventeenth embodiment of the present invention.

As shown in FIG. 35, a plurality of teeth 171 aligned along a shifting direction of a reflector plate 6 is formed thereon. A gear 172 is meshed with the teeth 172, and the gear 172 is rotated by a drive unit such as a motor (not shown), whereby the reflector plate 6 is shifted to be capable of changing a offset S. The teeth 171 are not necessarily required to form directly on the reflector plate 6, but it may be formed into a movable member incorporated with the reflector plate 6. The gear 172 may be a ball gear.

The invention is not limited to the construction as shown in FIG. 35, but any mechanism is applicable so far as the reflector plate 6 is relatively movable with respect to the substrate 2 while maintaining the angle of inclination $\alpha$.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

The invention claimed is:

1. An antenna device, comprising:

a dielectric substrate;

an electric supply line that comprises a microstrip line and is formed on the dielectric substrate;

an antenna element that comprises a microstrip line and is formed on the dielectric substrate; and a reflector plate disposed at a predetermined angle of inclination to the dielectric substrate, wherein the reflector plate is allowed to move relative to the dielectric substrate while keeping the predetermined angle of inclination.

2. The antenna device according to claim 1, wherein the electric supply line and the antenna element deviate from a dimensional factor that allows the electric supply line and the antenna element to have an omnidirectivity, and wherein the electric supply line and the antenna element have a dimensional factor that allows the electric supply line and the antenna element to have an elliptical directivity.

3. The antenna device according to claim 1, wherein a distance between the antenna element and an adjacent antenna element along a longitudinal direction of the dielectric substrate deviates from a distance between the antenna element and the adjacent antenna element along the longitudinal direction of the dielectric substrate that allows the electric supply line and the antenna element to have an omnidirectivity.

* * * * *